US007757340B2

(12) United States Patent
Sawalski

(10) Patent No.: US 7,757,340 B2
(45) Date of Patent: Jul. 20, 2010

(54) SOFT-SURFACE REMEDIATION DEVICE AND METHOD OF USING SAME

(75) Inventor: Michael M. Sawalski, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1468 days.

(21) Appl. No.: 11/090,438

(22) Filed: Mar. 25, 2005

(65) Prior Publication Data

US 2006/0213025 A1 Sep. 28, 2006

(51) Int. Cl.
*A47L 5/24* (2006.01)

(52) U.S. Cl. ..... 15/300.1; 15/320; 15/339; 15/344; 15/346; 15/347; 15/363; 15/393

(58) Field of Classification Search ..... 15/300.1, 15/320, 339, 344, 346, 347, 363, 393; *A47L 5/24*
See application file for complete search history.

(56) References Cited

U.S. PATENT DOCUMENTS

| | | | | |
|---|---|---|---|---|
| 513,390 | A | | 1/1894 | Griswold |
| 822,064 | A | | 5/1906 | Milham |
| 2,052,869 | A | | 9/1936 | Coanda |
| 2,088,028 | A | | 7/1937 | Mailander |
| 2,291,826 | A | | 8/1942 | Muffly |
| 2,583,374 | A | | 1/1952 | Hoffman |
| 2,665,943 | A | | 1/1954 | Palm |
| 2,945,554 | A | | 7/1960 | Berly |
| 2,953,208 | A | | 9/1960 | O'Connor |
| 3,047,208 | A | | 7/1962 | Coanda |
| 3,061,959 | A | * | 11/1962 | Blumenfeld ..... 38/77.8 |
| 3,201,772 | A | | 8/1965 | Ladusaw |
| 3,323,710 | A | | 6/1967 | Daly |
| 3,633,240 | A | | 1/1972 | Crener |
| 3,635,001 | A | | 1/1972 | Komroff et al. |
| 3,718,982 | A | | 3/1973 | Deaton |
| 3,840,309 | A | | 10/1974 | Eckes et al. |
| 3,872,540 | A | | 3/1975 | Block |
| 3,904,314 | A | | 9/1975 | Pedersen |
| 3,934,543 | A | | 1/1976 | Howard |
| 4,040,042 | A | | 8/1977 | Mayer |
| 4,123,818 | A | | 11/1978 | Hurwitz |
| 4,137,988 | A | | 2/1979 | Croix-Marie |
| 4,178,127 | A | | 12/1979 | Zahorecz |
| 4,204,298 | A | | 5/1980 | Handa et al. |
| 4,321,070 | A | | 3/1982 | Bede |
| 4,419,784 | A | | 12/1983 | Lex |
| 4,462,137 | A | | 7/1984 | Berfield et al. |

(Continued)

FOREIGN PATENT DOCUMENTS

| | | |
|---|---|---|
| CA | 1135910 | 11/1982 |

(Continued)

*Primary Examiner*—David A Redding

(57) ABSTRACT

A soft-surface remediation (SSR) device and method of remediating soft surfaces using preferably forced air is disclosed. The device is lightweight, and easy-to-use and preferably includes an outer housing with an optional corner pickup region and a removable cover, an inner housing, a motor housing for housing a fan assembly, an optional disposal catch mechanism, an optional mounted delivery device, a first air channel with an air outlet, a second air channel with an air inlet, and a return air channel in close proximity to the disposal mechanism. The method of performing soft-surface remediation preferably includes use of this SSR device.

20 Claims, 33 Drawing Sheets

U.S. PATENT DOCUMENTS

| | | | |
|---|---|---|---|
| 4,474,534 | A | 10/1984 | Thode |
| 4,521,158 | A | 6/1985 | Fickelscher |
| 4,554,698 | A | 11/1985 | Rennecker et al. |
| 4,571,849 | A | 2/1986 | Gardner et al. |
| 4,586,751 | A | 5/1986 | McGuire |
| 4,597,124 | A | 7/1986 | Williams, III et al. |
| 4,606,290 | A | 8/1986 | Marzotto |
| 4,610,600 | A | 9/1986 | Bleier |
| 4,624,649 | A | 11/1986 | Blocker |
| 4,624,690 | A | 11/1986 | Byrnes |
| 4,643,775 | A | 2/1987 | Reba et al. |
| 4,656,688 | A | 4/1987 | Jacob et al. |
| 4,658,464 | A | 4/1987 | Sharp |
| 4,671,567 | A | 6/1987 | Frobose |
| 4,672,695 | A | 6/1987 | Fuss |
| 4,675,347 | A | 6/1987 | Mochizuki et al. |
| 4,678,595 | A | 7/1987 | Malik et al. |
| 4,697,847 | A | 10/1987 | Herschlag |
| 4,703,538 | A | 11/1987 | Silverstrone |
| 4,714,097 | A | 12/1987 | Binzen et al. |
| 4,735,626 | A | 4/1988 | Smith et al. |
| 4,747,364 | A | 5/1988 | Horowitz |
| 4,751,501 | A | 6/1988 | Gut |
| 4,766,638 | A | 8/1988 | McDowell |
| 4,809,396 | A | 3/1989 | Houser |
| 4,824,719 | A | 4/1989 | Creyf et al. |
| 4,837,875 | A | 6/1989 | Shamie et al. |
| 4,848,839 | A | 7/1989 | Galardo |
| 4,857,377 | A | 8/1989 | Daimon et al. |
| 4,873,422 | A | 10/1989 | Streich et al. |
| 4,884,315 | A | 12/1989 | Ehnert |
| 4,914,772 | A | 4/1990 | Difloe |
| 4,932,720 | A | 6/1990 | Sherman |
| 4,951,346 | A | 8/1990 | Salmon |
| 4,955,995 | A | 9/1990 | Pontius |
| 5,029,359 | A | 7/1991 | Ortega |
| 5,060,341 | A | 10/1991 | Nelle |
| 5,074,997 | A | 12/1991 | Riley et al. |
| 5,115,765 | A | 5/1992 | El Omary |
| 5,141,204 | A | 8/1992 | Marosy |
| 5,141,309 | A | 8/1992 | Warwag |
| 5,154,398 | A | 10/1992 | Mayfield |
| 5,168,599 | A | 12/1992 | Williams |
| 5,173,307 | A | 12/1992 | Nestle |
| 5,176,860 | A | 1/1993 | Storch |
| 5,188,343 | A | 2/1993 | Galea |
| 5,203,521 | A | 4/1993 | Day |
| 5,205,156 | A | 4/1993 | Asano et al. |
| 5,219,633 | A | 6/1993 | Sabee |
| 5,228,157 | A | 7/1993 | Johenning et al. |
| 5,231,717 | A | 8/1993 | Scott et al. |
| 5,237,719 | A | 8/1993 | Dwyer et al. |
| 5,239,610 | A | 8/1993 | Shao |
| 5,244,468 | A | 9/1993 | Harris et al. |
| 5,249,925 | A | 10/1993 | Guimbal et al. |
| 5,259,984 | A | 11/1993 | Hull |
| 5,263,764 | A | 11/1993 | Laughlin et al. |
| 5,284,597 | A | 2/1994 | Rees |
| 5,287,588 | A | 2/1994 | Gurstein et al. |
| 5,289,610 | A | 3/1994 | Monson |
| 5,302,001 | A | 4/1994 | Van Dis |
| 5,311,023 | A | 5/1994 | Means, Jr. et al. |
| 5,315,726 | A | 5/1994 | Borenstein |
| 5,331,697 | A | 7/1994 | Siegel et al. |
| 5,335,383 | A | 8/1994 | Schwind |
| 5,348,556 | A | 9/1994 | Minns et al. |
| 5,351,646 | A | 10/1994 | Zoroufy |
| 5,377,378 | A | 1/1995 | Cutler |
| 5,378,254 | A | 1/1995 | Maly et al. |
| 5,388,302 | A | 2/1995 | Sundaram et al. |
| 5,392,490 | A | 2/1995 | Monson |
| 5,392,492 | A | 2/1995 | Fassauer |
| 5,394,810 | A | 3/1995 | Howard et al. |
| 5,394,926 | A | 3/1995 | Kraeutler |
| 5,415,461 | A | 5/1995 | Sakamoto |
| 5,432,975 | A | 7/1995 | Hilmanowski |
| 5,435,817 | A | 7/1995 | Davis et al. |
| 5,455,979 | A | 10/1995 | Bores et al. |
| 5,461,368 | A | 10/1995 | Comer |
| 5,478,133 | A | 12/1995 | Tidwell |
| 5,478,201 | A | 12/1995 | Amr |
| 5,492,540 | A | 2/1996 | Leifheit et al. |
| 5,493,752 | A | 2/1996 | Crouser et al. |
| 5,515,569 | A | 5/1996 | Montabaur et al. |
| 5,516,384 | A | 5/1996 | Mossbeck |
| 5,538,325 | A | 7/1996 | Bullard |
| 5,544,943 | A | 8/1996 | Durling |
| 5,551,122 | A | 9/1996 | Burkhardt et al. |
| 5,555,595 | A | 9/1996 | Ligman |
| 5,564,160 | A | 10/1996 | Luebbeing |
| 5,569,521 | A | 10/1996 | Francoeur et al. |
| 5,577,294 | A | 11/1996 | Pollock |
| 5,584,094 | A | 12/1996 | Gurstein |
| 5,601,340 | A | 2/1997 | Stout |
| 5,604,953 | A | 2/1997 | Castwall et al. |
| 5,613,269 | A | 3/1997 | Miwa |
| 5,620,306 | A | 4/1997 | Day |
| 5,624,465 | A | 4/1997 | Harris |
| 5,633,017 | A | 5/1997 | Sebag |
| 5,638,562 | A | 6/1997 | Masoncup |
| 5,640,739 | A | 6/1997 | Campbell |
| 5,643,775 | A | 7/1997 | Takahashi et al. |
| 5,647,092 | A | 7/1997 | Miwa |
| 5,647,285 | A | 7/1997 | Steward |
| 5,676,163 | A | 10/1997 | Behan et al. |
| 5,678,897 | A | 10/1997 | Prestia |
| 5,679,137 | A | 10/1997 | Erdman et al. |
| 5,700,060 | A | 12/1997 | Bullard et al. |
| 5,718,729 | A | 2/1998 | Harris |
| 5,718,822 | A | 2/1998 | Richter |
| 5,720,057 | A | 2/1998 | Duncan |
| 5,733,397 | A | 3/1998 | McDaniel |
| 5,753,607 | A | 5/1998 | Burke et al. |
| 5,768,747 | A | 6/1998 | Smith |
| 5,774,056 | A | 6/1998 | Berry, III et al. |
| 5,796,472 | A | 8/1998 | Wirthlin |
| 5,797,161 | A | 8/1998 | Campbell |
| 5,799,362 | A | 9/1998 | Huffman |
| 5,801,211 | A | 9/1998 | Tornero et al. |
| 5,802,637 | A | 9/1998 | Bordo |
| 5,802,664 | A | 9/1998 | Mondigo et al. |
| 5,810,908 | A | 9/1998 | Gray et al. |
| 5,822,817 | A | 10/1998 | Carew et al. |
| 5,823,200 | A | 10/1998 | Persaud |
| 5,826,301 | A | 10/1998 | Kang et al. |
| 5,832,559 | A | 11/1998 | Kang |
| 5,850,667 | A | 12/1998 | Orsini |
| 5,851,457 | A | 12/1998 | Peterson et al. |
| 5,860,188 | A | 1/1999 | Maurer et al. |
| 5,884,360 | A | 3/1999 | Palffy |
| 5,890,249 | A | 4/1999 | Hoffman |
| 5,890,258 | A | 4/1999 | Lee |
| 5,895,504 | A | 4/1999 | Sramek et al. |
| 5,904,755 | A | 5/1999 | Kanazashi et al. |
| 5,911,265 | A | 6/1999 | Dreher |
| 5,911,654 | A | 6/1999 | Webb |
| 5,914,453 | A | 6/1999 | James et al. |
| 5,917,141 | A | 6/1999 | Naquin, Jr. |
| 5,920,953 | A | 7/1999 | Shero |
| 5,935,364 | A | 8/1999 | Groendal et al. |
| 5,950,264 | A | 9/1999 | Wyner et al. |
| 5,966,759 | A | 10/1999 | Sanders et al. |
| 5,968,204 | A | 10/1999 | Wise |
| 5,970,577 | A | 10/1999 | Kim |

5,971,452 A 10/1999 Marymor et al.
5,979,003 A 11/1999 Billat
5,983,442 A 11/1999 Louis et al.
5,985,811 A 11/1999 Masayuki et al.
6,010,539 A 1/2000 Del Pesco
6,038,722 A 3/2000 Giori et al.
6,042,333 A 3/2000 Day
6,047,435 A 4/2000 Suzuki et al.
6,052,866 A 4/2000 Tuvin et al.
6,055,699 A 5/2000 Cho
6,056,109 A 5/2000 Hidai
6,056,209 A 5/2000 Rivera
6,066,011 A 5/2000 Day
6,071,869 A 6/2000 Materniak et al.
6,077,336 A 6/2000 Ulrich et al.
6,082,376 A 7/2000 Karr et al.
6,101,670 A 8/2000 Song
6,110,260 A 8/2000 Kubokawa
6,116,693 A 9/2000 Zammit
6,119,290 A 9/2000 Masoncup
6,123,618 A 9/2000 Day
6,126,697 A 10/2000 Ebberts
6,134,746 A 10/2000 Miller et al.
6,135,127 A 10/2000 Pieper
6,136,730 A 10/2000 Kimbrell et al.
6,146,759 A 11/2000 Land
6,170,293 B1 1/2001 Cody
6,173,465 B1 1/2001 Deneau
6,185,781 B1 2/2001 Miller et al.
6,199,244 B1 3/2001 Hilgers et al.
6,199,251 B1 3/2001 Zeiler
6,231,647 B1 5/2001 Cheng
6,235,090 B1 5/2001 Bernstein et al.
6,239,166 B1 5/2001 Black
6,239,694 B1 5/2001 Honda et al.
6,243,914 B1 6/2001 Studebaker
6,260,224 B1 7/2001 Pinkus
6,260,233 B1 7/2001 Wareham
6,267,446 B1 7/2001 Wieland
6,277,808 B1 8/2001 Tcheou et al.
6,295,674 B1 10/2001 Smith-McKelvey et al.
6,306,234 B1 10/2001 Barker et al.
6,324,722 B1 12/2001 Takemoto
6,324,875 B1 12/2001 Hoermann
6,341,403 B1 1/2002 Strickrodt et al.
6,363,553 B1 4/2002 Baumgartel et al.
6,367,880 B1 4/2002 Niederman et al.
6,412,435 B1 7/2002 Timmons, Jr.
6,425,637 B1 7/2002 Peterson
6,438,778 B1 8/2002 Johnson
6,442,780 B1 9/2002 Phillips et al.
6,446,293 B2 9/2002 Lindquist et al.
6,447,587 B1 9/2002 Pillion et al.
6,448,896 B1 9/2002 Bankus et al.
6,460,191 B1 10/2002 Lorkovic
6,474,936 B1 11/2002 DeBlanc et al.
6,481,963 B1 11/2002 Lin et al.
6,490,753 B1 * 12/2002 Chen ..... 15/320
6,490,755 B2 12/2002 Paterson
6,492,563 B2 12/2002 Gautschi
6,494,940 B1 12/2002 Hak
6,497,553 B2 12/2002 Illingworth et al.
6,500,445 B1 12/2002 Pullen
6,505,379 B2 1/2003 Keller
6,508,868 B2 1/2003 Pillion et al.
6,543,726 B2 4/2003 Illingworth
6,547,519 B2 4/2003 DeBlanc et al.
6,547,643 B1 4/2003 Miller, III et al.
6,550,639 B2 4/2003 Brown
6,554,207 B2 4/2003 Ebberts
6,565,035 B1 5/2003 Kim et al.
6,565,321 B1 5/2003 Illingworth et al.
6,581,241 B2 6/2003 Shaver et al.
6,595,753 B1 7/2003 Illingworth et al.
6,612,402 B1 9/2003 Illingworth
6,616,736 B2 9/2003 Massey et al.
6,619,922 B2 9/2003 Illingworth et al.
6,623,265 B1 9/2003 Day
6,623,352 B2 9/2003 Illingworth
6,631,529 B1 10/2003 Erickson
6,634,855 B1 10/2003 Rollo
6,647,586 B2 11/2003 Rogers et al.
6,659,550 B2 12/2003 Hackett
6,687,951 B2 2/2004 Illingworth et al.
6,689,225 B2 2/2004 Illingworth
6,691,369 B1 * 2/2004 Weiss ..... 15/344
6,696,395 B1 2/2004 Ireton et al.
6,708,941 B1 3/2004 Bowen et al.
6,719,830 B2 4/2004 Illingworth et al.
6,721,982 B2 4/2004 Freeman
6,725,500 B2 4/2004 Allen et al.
6,726,284 B2 4/2004 Cleary
6,729,839 B1 5/2004 Illingworth et al.
6,735,800 B1 5/2004 Salvatini et al.
6,742,626 B2 6/2004 Illingworth
6,746,166 B1 6/2004 Jeon et al.
6,746,617 B2 6/2004 Radomyselski et al.
6,772,472 B2 8/2004 Wang
6,790,259 B2 9/2004 Rittri et al.
6,800,106 B2 10/2004 Cogar, Sr. et al.
6,802,271 B2 10/2004 Oxley et al.
6,802,693 B2 10/2004 Reinfeld et al.
6,802,881 B2 10/2004 Illingworth et al.
6,807,694 B1 10/2004 Miller
6,811,687 B2 11/2004 Illingworth
6,813,807 B2 11/2004 Ibbertson et al.
6,820,305 B2 11/2004 Kess et al.
6,854,143 B2 2/2005 Sharples
6,863,704 B2 3/2005 Pillion et al.
6,881,025 B2 4/2005 Illingworth et al.
6,901,618 B2 6/2005 Oakhill
6,918,143 B2 7/2005 Wiberg
6,925,945 B2 8/2005 Babick et al.
6,935,839 B2 8/2005 Pascoe
6,948,204 B2 9/2005 Chae
6,960,063 B2 11/2005 Reinfeld et al.
7,018,438 B2 3/2006 Duggan
2001/0045159 A1 11/2001 Johnson et al.
2001/0045325 A1 11/2001 Illingworth
2001/0052723 A1 12/2001 Wu
2002/0084218 A1 7/2002 Illingworth
2002/0094271 A1 7/2002 Yeuan et al.
2002/0104184 A1 8/2002 Rogers et al.
2002/0137156 A1 9/2002 Margolin et al.
2002/0148069 A1 10/2002 Illingworth
2002/0151634 A1 10/2002 Rohrbaugh et al.
2002/0155002 A1 10/2002 Reinfeld et al.
2002/0157210 A1 10/2002 Minor
2002/0176777 A1 11/2002 Reinfeld et al.
2002/0176778 A1 11/2002 Reinfeld et al.
2002/0176854 A1 11/2002 Payton
2002/0182077 A1 12/2002 Reinfeld et al.
2002/0189048 A1 12/2002 Maruyama et al.
2003/0000021 A1 1/2003 O'Connell et al.
2003/0049407 A1 3/2003 Kacher et al.
2003/0062407 A1 4/2003 Kim
2003/0062507 A1 4/2003 Radomyselski et al.
2003/0066268 A1 4/2003 George
2003/0070692 A1 4/2003 Smith et al.
2003/0082972 A1 5/2003 Monfalcone et al.
2003/0104745 A1 6/2003 Curtis
2003/0136094 A1 7/2003 Illingworth et al.
2003/0150060 A1 8/2003 Huang
2003/0150198 A1 8/2003 Illingworth et al.
2003/0151293 A1 8/2003 McLarty et al.
2003/0162685 A1 8/2003 Man et al.

2003/0165383 A1 9/2003 Pascoe
2003/0167741 A1 9/2003 Illingworth et al.
2003/0170453 A1 9/2003 Foss et al.
2003/0182756 A1 10/2003 Duggan
2003/0183085 A1 10/2003 Alexander
2003/0192144 A1 10/2003 Song et al.
2003/0199220 A1 10/2003 Dawson, Jr. et al.
2004/0005992 A1 1/2004 Ebberts
2004/0009094 A1 1/2004 Adiga et al.
2004/0014633 A1 1/2004 Aida et al.
2004/0018089 A1 1/2004 Illingworth et al.
2004/0040579 A1 3/2004 Smith
2004/0069145 A1 4/2004 Illingworth et al.
2004/0091357 A1 5/2004 Reinfeld et al.
2004/0097156 A1 5/2004 McGuire et al.
2004/0101347 A1 5/2004 Beard
2004/0102562 A1 5/2004 Butuc
2004/0118091 A1 6/2004 Illingworth et al.
2004/0134024 A1 7/2004 Allen
2004/0137812 A1 7/2004 Suzuki et al.
2004/0139552 A1 7/2004 Walters
2004/0139709 A1 7/2004 Illingworth et al.
2004/0139710 A1 7/2004 Illingworth et al.
2004/0147191 A1 7/2004 Wen
2004/0154106 A1 8/2004 Oles et al.
2004/0158058 A1 8/2004 Cash et al.
2004/0158954 A1 8/2004 Bailey et al.
2004/0172763 A1 9/2004 Sachs et al.
2004/0172769 A1 9/2004 Giddings et al.
2004/0208746 A1 10/2004 Crocker
2004/0216264 A1 11/2004 Shaver et al.
2004/0238976 A1 12/2004 Johns
2006/0137132 A1* 6/2006 Orubor ..... 15/344
2008/0244858 A1* 10/2008 Shaver et al. ..... 15/327.5

FOREIGN PATENT DOCUMENTS

DE 10246676 A1 4/2004
EP 0285096 A2 10/1988
EP 1059056 A1 12/2000
EP 1097666 A2 5/2001
EP 0 871 808 B1 2/2003
GB 2338404 A 12/1999
JP 9-135795 5/1997
WO WO 83/01734 5/1983
WO WO 94/03553 2/1994
WO WO 94/11638 5/1994
WO WO 96/23140 8/1996
WO WO 96/24772 8/1996
WO WO 97/03180 1/1997
WO WO 97/08983 3/1997
WO WO 97/09234 3/1997
WO WO 97/43374 11/1997
WO WO 00/19881 4/2000
WO WO 00/38896 7/2000
WO WO 00/44271 8/2000
WO WO 00/55292 9/2000
WO WO 02/095646 A2 11/2002
WO WO 03/070078 A1 8/2003
WO WO 03/078100 A1 9/2003
WO WO 03/100254 A1 12/2003

* cited by examiner

Snap fit to bottom of motor housing base plate

Pressed onto bottom of motor housing base plate using hook and loop lock or adhesive

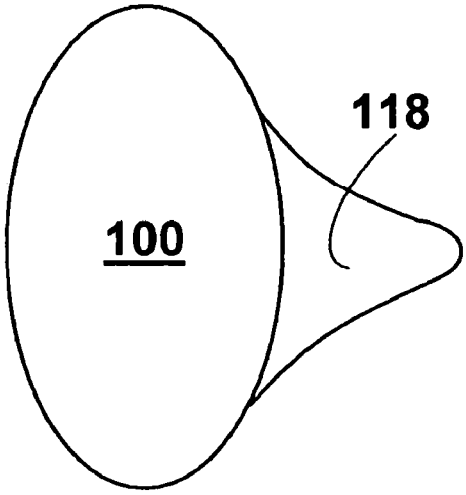
Fig. 16A
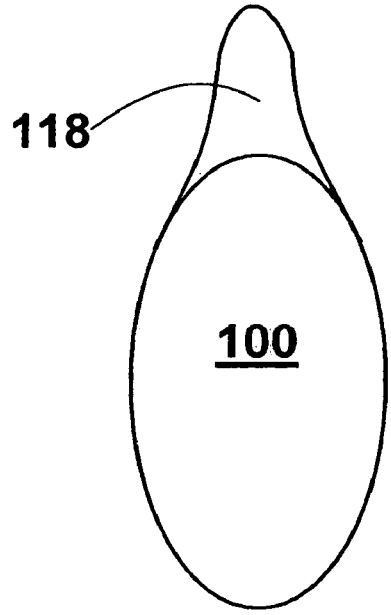
Fig. 16B
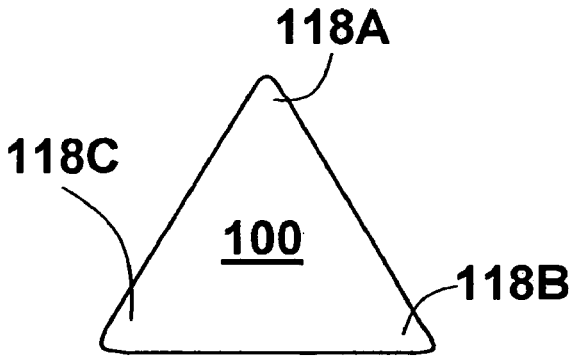
Fig. 16C
Fig. 16

SOFT-SURFACE REMEDIATION DEVICE AND METHOD OF USING SAME

BACKGROUND OF THE INVENTION

1. Field of the Invention

The present invention relates to an apparatus for soft-surface remediation (SSR). SSR is any treatment to relieve, prevent or cure the adverse effects of contaminants that collect on or in soft surfaces. In particular, this invention relates to a SSR device that preferably uses forced air as the dislodging, displacing and delivery mechanism.

2. Discussion of Related Art

Indoor air is a good transport mechanism for odors and airborne contaminants, such as dust and allergens. Dust is generally characterized as including, for example, soot, pet dander, skin flakes, carpet fibers, dust mite debris, hair, and lint. Allergens are generally characterized as including, for example, dust mites, pet dander, mold/mildew, pollen, and microbes, such as germs and bacteria. Odors are generally characterized as including, for example, pet smells, body odor, or cooking smells. For energy efficiency reasons, modern homes are constructed to be as airtight as possible. This has the adverse effect of creating an environment of poor indoor air quality because it takes a significant amount of time to circulate air into and out of a room. Consequently, airborne contaminants remain circulating in the air in the home and, over time, may land on hard and soft surfaces. Hard surfaces are, for example, floors, counter tops, and the wooden, metal, or glass components of furniture. Soft surfaces are, for example, upholstery, mattresses, pillows, carpets and drapes.

Soft surfaces are typically formed by a number of strands of thread or fiber. These strands may be woven together in a specific pattern to form a thick surface or may be in the form of a thin, non-woven mesh. Most furniture upholstery is of the woven type. Contaminants become lodged in between the weave of the fibers and on the fibers themselves. In the case of odors, the molecules attach themselves on or to the fibers. The typical structure of upholstered furniture is outer woven fabric atop a thin layer of batting material, which is atop a thick inner foam that provides firmness for, for example, supporting a person's weight. The vast majority of contaminants reside within the weave of the surface fabric or on or below the surface of the batting material of the upholstered item. The surface of the outer woven fabric becomes a collection area for crumbs, hair, dust, lint, and stains. In particular, hair, dust, lint, and dust mite debris become lodged between the surface fabric weave. The batting material becomes a repository for hair, dust mites, dust mite debris, and mold/mildew spores. Mold/mildew spores, bacteria, and germs are found on the surface of the inner foam.

Technical challenges exist with regard to soft surface remediation (SSR). SSR preferably involves a process supported by electrostatics, mechanics, air, acoustics, chemistry and/or other technologies to dislodge, displace and dispose of contaminants from soft surfaces and, optionally, to treat those same surfaces in at least two different ways. As such, there are preferably five components of soft-surface remediation: (1) dislodging, which is the act of freeing dust, dirt, hair, etc., from, near, or within the surface, (2) displacing, which is the act of moving dust, dirt, hair, etc., to a containment mechanism after it has been dislodged, (3) disposing, which is the act of capturing the contaminants via a containment mechanism, (4) delivery, which is the act of delivering a chemical or other benefit to the surface, e.g., disinfecting, or applying a treatment to control dust mites, bacteria, mold, etc. or, alternatively, to remove odors or otherwise improve the scent or perceived "freshness" of the soft surface, and (5) defending, which is the act of applying a treatment to protect the soft surface from future contaminants.

A vacuum cleaner is a well-known household item used for cleaning. A typical vacuum cleaner consists of a suction fan driven by a motor and a suction nozzle with a rotating brush that has a beating effect (for dislodging) on the surface to be cleaned, such as a carpet. Vacuum cleaners exist in various forms, such as a canister type or upright type of design. Both types of vacuum cleaners have considerable weight and are, therefore, cumbersome to use. Additionally, typical canister or upright vacuum cleaners are corded, which limits their easy accessibility to some areas of the home. Standard vacuum cleaners are too cumbersome for use on soft surfaces, such as furniture upholstery, mattresses, and drapes. And, the mechanical dislodging mechanism of standard vacuum cleaners may be destructive to the fabric itself.

Alternatively, handheld portable vacuum cleaners exist in the market today, such as the DustBuster® handheld vacuum manufactured by Black & Decker (Towson, Md.). However, handheld portable vacuum cleaners generally do not include a dislodging mechanism rather they use vacuum power only. Consequently, handheld portable vacuum cleaners are not powerful enough to clean to any sufficient depth and, thus, only the surface is cleaned. They may not have adequate power to get at contaminants which are embedded within the weave or fibers. In particular, handheld portable vacuum cleaners are not effective in removing hair, as hair is difficult to remove because of the static cling to fabrics and the entanglement into the weave of the fabric itself. Additionally, handheld portable vacuum cleaners generally have a small opening, so the user must operate the device slowly and with many passes over the surface to be cleaned, in order for it to work effectively.

In some cases, a chemical or other material may be desired for odor removal, freshening, disinfecting, assisting in the removal of contaminants from a soft surface or preventing future contaminants. However, it is difficult to introduce chemistry to the surface to be cleaned by use of a standard vacuum cleaner or a handheld portable vacuum cleaner as neither includes a chemical delivery system. The consumer typically must, therefore, resort to a separate device for applying a chemical, which means that the consumer is spending additional time performing separate freshening, disinfecting, cleaning and preventing operations.

As a preventative measure, frequent touchup cleaning is beneficial to soft surfaces for delaying more involved and destructive deep-cleaning events. Generally, upholstery does not get as dirty when frequent touchups are performed, as compared with relying on occasional deep cleaning. However, consumers tend not to do touchup cleaning, because existing soft-surface touchup cleaning approaches are not very effective or convenient. Deep cleaning is effective, but very laborious and requires powerful tools, chemistry, and energy. Furthermore, the more effective the deep-cleaning event, the more damaging it is potentially to the soft surface.

What is therefore needed is an easy-to-use, convenient mechanism for performing touchup cleaning that encourages frequent use and, thus, minimizes the need for deep-cleaning events. What is also needed is a more effective and efficient way to introduce chemistry onto a soft surface by use of a low-powered, lightweight, forced air SSR device and, therefore, reduce the overall time for performing cleaning, freshening, and disinfecting operations. What is additionally needed is a forced air SSR device that has a large pickup area in order to reduce the cleaning time. What is further needed is a forced air SSR device that has a dislodging mechanism for effectively performing soft-surface remediation but in a non-destructive manner. What is further needed is a method to trap contaminants from the item being cleaned which allows for easy cleaning or disposal to remove the contaminants from the system and the users environment.

The disclosures of all of the below-referenced prior United States patents, and applications, in their entireties are hereby expressly incorporated by reference into the present application for purposes including, but not limited to, indicating the background of the present invention and illustrating the state of the art.

U.S. Patent Application No. 20040172769, "Method and apparatus for cleaning fabrics, floor coverings, and bare floor surfaces utilizing a soil transfer cleaning medium," to Giddings et. al. describes an apparatus and method for cleaning fabrics, floor coverings, and bare floor surfaces utilizing a soil transfer cleaning medium. A method of mechanically removing soil from a surface intended to be cleaned includes the steps of successively and repeatedly: wetting a portion of a cleaning medium with a cleaning liquid; extracting any soil and at least some of the cleaning liquid from the previously wetted portion of the cleaning medium; and wiping the surface intended to be cleaned with the portion of the cleaning medium so as to transfer soil from the surface intended to be cleaned to the cleaning medium. Portable and vehicle-based devices may be utilized to practice the method of cleaning.

U.S. Patent Application No. 20020104184, "Portable vacuum cleaning apparatus," to Rogers et. al. describes a portable vacuum cleaning apparatus intended to be carried either on a single shoulder or worn backpack style, wherein the vacuum cleaner has an extensible tube and nozzle arrangement that may be held substantially fully enclosed in the vacuum cleaner case, wherein the hose or wand may be collapsed when not in use to prevent entanglement, or may be incrementally extended and secured in a desired position for use. The invention also includes a suspension arrangement for flexibly suspending the internal components of the vacuum and for providing a moment to counteract the force and movement of the wand.

U.S. Pat. No. 6,042,333, "Adjustable pitch impeller," to Day describes an impeller that has a plurality of rotating passageways which can be defined between adjacent blades, the blades having a curved root portion and able to pivot across a part spherical hub to maintain a fine line contact. The passageways have a convergence to improve the efficiency of the impeller. The hub can be split into two relatively rotating portions, with the blades attached to each portion to provide an efficient means to vary the pitch of the blades.

U.S. Pat. No. 5,620,306, "Impeller," to Day describes a pressure boost impeller configured for compressing fluids, such as gases and liquids. Such impeller has a front intake area and a rear discharge area, and a hub containing the rotational axis of the impeller. Several blades extend about the hub, with some of the blades being in an overlapping relationship to define a passageway between adjacent blades. The passageway has an inlet communicating with the front intake area and an outlet communicating with the rear discharge area. The inlet is greater in area than the outlet, thus defining a step down in volume of fluid passing through the passageway.

U.S. Pat. No. 5,604,953, "Vacuum cleaner," to Castwall, et. al. describes vacuum cleaner including a unit, comprising an electric motor and an associated suction fan, and a suction nozzle connected to the inlet side of the unit via a dust separating device, either directly or via a connectable rigid conduit. The vacuum cleaner comprises a handheld unit which when not in use is arranged to be positioned on a stationary storage unit, said handheld unit incorporating the said unit and the dust separating device and being provided with a coupling means for connecting of the rigid conduit. For power supply purposes, by means of an extensible flex, the handheld unit is connected to the storage unit which via an additional flex is connectable to a mains outlet.

U.S. Pat. No. 5,551,122, "Corded handheld vacuum cleaner," to Burkhardt, et. al. describes a handheld vacuum cleaner that has a motor mounted with the rotational axis of its shaft parallel to the rotational axis of the rotating brush. The vacuum cleaner motor has an end bell, which is attached to the motor stator, and which holds a motor shaft bearing. The end bell is secured to the vacuum housing with an elastomeric mounting ring to dampen motor vibrations. The need for most motor mounting hardware is eliminated, because the housing supports the motor stator directly. The intake orifice of the vacuum is shaped to lie in two distinct planes, so that flat cleaning surfaces do not obstruct the orifice. The shape of the intake also allows one to clean immediately adjacent to a vertical wall.

U.S. Pat. No. 6,123,618, "Air Movement Apparatus" to Day discloses an air movement apparatus that includes a curved, toroidal shaped body having a central passageway and an outer rim. The apparatus further includes an air acceleration means such as a bladed fan having a hub and a number of overlapping blades. The fan also has a shaft driven by a motor. The upper portion of the central passageway is partially closed by a first barrier member. Specifically, the peripheral edge of the first barrier member is paced inwardly from the outer wall of the body to define an annular blowing slot which forms the air outlet. The first barrier member is slidably attached by to float above the body in a manner that increases or decreases the size of the annular slot depending on the volume and velocity of air passing therethrough. Movement of air about the curved body creates turbulence such as vortices having a lower pressure than ambient air. The vortices roll around the curved body such that a portion of the air to be ejected out, and a remaining portion of the air to be re-circulated into the central passageway. A heating element is positioned to heat the air as it passes through the passageway.

Application No. WO 00/19881, "An Apparatus for Picking Up and Collecting Particulate Material" to Day discloses an apparatus to separate a particle containing fluid such as dust laden air. The apparatus uses a Coanda blowing slot to entrap particles into a recirculating fluid stream, and strips the particles out of the fluid stream in a separation chamber preferably using a vortex system. The apparatus can be a zero emission apparatus making it suitable in areas where conventional vacuum cleaners are inappropriate.

U.S. Patent No. 6,687,951, "Toroidal Vortex Bagless Vacuum Cleaner" to Illingworth, et. al. builds on the technology disclosed in U.S. Pat. No 6,595,753, "Vortex Attractor" to Illingworth, et. al. The disclosed vortex attractor is used alone or in conjunction with mechanical or electronic devices to act upon a fluid to create a vortex flow in a closed circulating manner such that there is no separate fluid intake or exhaust. An impeller is conFig.d to draw a fluid tangentially in an upward direction that resembles a spiral, with a loop that travels through the center of the spiral to the region above an inlet to the impeller. The vortex attractor creates a low-pressure area that extends from the impeller toward an object to be attracted. The vortex attractor is used in the '951 patent to provide a toroidal vortex bagless vacuum cleaner.

U.S. Pat. No. 5,074,997, "Filter and Process for Making a Filter for Dispersing Ingredients into Effluent" to Riley et al. discloses a filter applied with differential levels of active ingredients (e.g., deodorant, perfume, etc.) that can be employed in disposable vacuum cleaner bags. As air passes through the filter, the filter disperses the active ingredients into the effluent air. The active ingredients are distributed unevenly in the filter substrate in a pattern determined by the changing flow pattern of the air through the substrate as particulate matter accumulates against the filter.

Other patents are

U.S. Pat. No. 5,492,540, "Soft surface cleaning composition and method with hydrogen peroxide" to Leifheit, et. al.;

U.S. Pat. No. 5,895,504, "Methods for using a fabric wipe" to Sramek, et. al.;

U.S. Pat. No. 5,284,597, "Aqueous alkaline soft surface cleaning compositions comprising tertiary alkyl Hydroperoxides" to Rees;

U.S. Pat. 4,597,124, "Method and apparatus for cleaning upholstery" to Williams, et. al.;

U.S. Pat. No. 5,968,204, "Article for cleaning surfaces" to Wise; and

U.S. Pat. No. 6,696,395, "Perfumed liquid household cleaning fabric treatment and deodorizing compositions packaged in polyethylene bottles modified to preserve perfume integrity" to Woo, et. al.

SUMMARY OF THE INVENTION

By way of summary, the present invention preferably provides:

- a convenient forced air SSR device that has a dislodging mechanism for effectively performing soft-surface remediation in a gentler manner;
- a SSR device that has a large pickup area, in order to reduce the cleaning time;
- a more effective and efficient way to introduce chemistry onto a soft surface by use of a low-powered, lightweight forced air SSR device;
- a forced air SSR device that reduces the time required for introducing material onto a soft surface for cleaning, freshening, and disinfecting operations;

an easy-to-use, convenient mechanism that encourages consumers to perform touchup cleaning events more frequently.

Various consumables may aid the device of the present invention in this purpose, for example, disposable filters, scrubbing members, cleaning heads, and various other cleaning materials. For example, perfume or other scents also may be used for freshening the air that is circulated through the device, and compositions for dealing with refreshing fabrics, stain removal and antibacterial control may also be provided.

These and other aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views.

FIG. 16A-C illustrate other possible embodiments;

Note while some text has been added to the drawings it has been done to merely provide further detail to the illustrated embodiments and should be taken as limiting the invention to that which is shown or disclosed thereon.

DESCRIPTION OF THE PREFERRED EMBODIMENTS

1. System Overview

The present invention is soft-surface remediation (SSR) device and method of remediating soft surfaces, such as upholstery that preferably uses forced air to accomplish its objective. In its simplest form, the SSR device is a device that pushes a fluid out and sucks it back in, cleaning the surface and the fluid as it does so.

The SSR device of the present invention is preferably a lightweight, easy-to-use device that includes an outer housing, at least one optional corner pickup region, a removable cover, an inner housing, a motor housing for housing a fan assembly, an optional disposal catch mechanism, an optional mounted delivery device, a first air channel with an air outlet, a second air channel with an air inlet, and a return air channel in close proximity to the disposal mechanism. The preferred method of performing soft-surface remediation by use of the SSR device of the present invention includes the steps of retrieving the SSR device from storage, installing the consumables into the device, activating the device, performing the SSR operation, deactivating the device, removing the consumables, preparing for another use, storing the device and, optionally, recharging batteries.

2. Detailed Description of the Preferred Embodiments

The present invention is preferably a forced air device for and method for soft surface remediation (SSR) including dislodging, displacing, and disposing of contaminants from soft surfaces, such as upholstery. The forced air SSR device of the present invention effectively performs soft-surface remediation in a gentler, less destructive manner and is preferably low-powered and lightweight. It also preferably has as large pickup area for providing a faster cleaning operation, provides a delivery mechanism for materials for protecting, freshening, disinfecting, cleaning and preventing and provides an easy-to-use, convenient mechanism that encourages consumers to perform touchup cleaning events more frequently. For the purposes of this disclosure, the term "cleaning" or "cleaned" is broadly expanded to include operations associated with SSR. The materials used for further cleaning may include cleaning chemicals, odor eliminators, stain removal, fabric protectors, fresheners, and disinfectants all of which may be in the form of liquids, gases, solids, gels, substrates and/or powders or combinations thereof.

Figure 1:
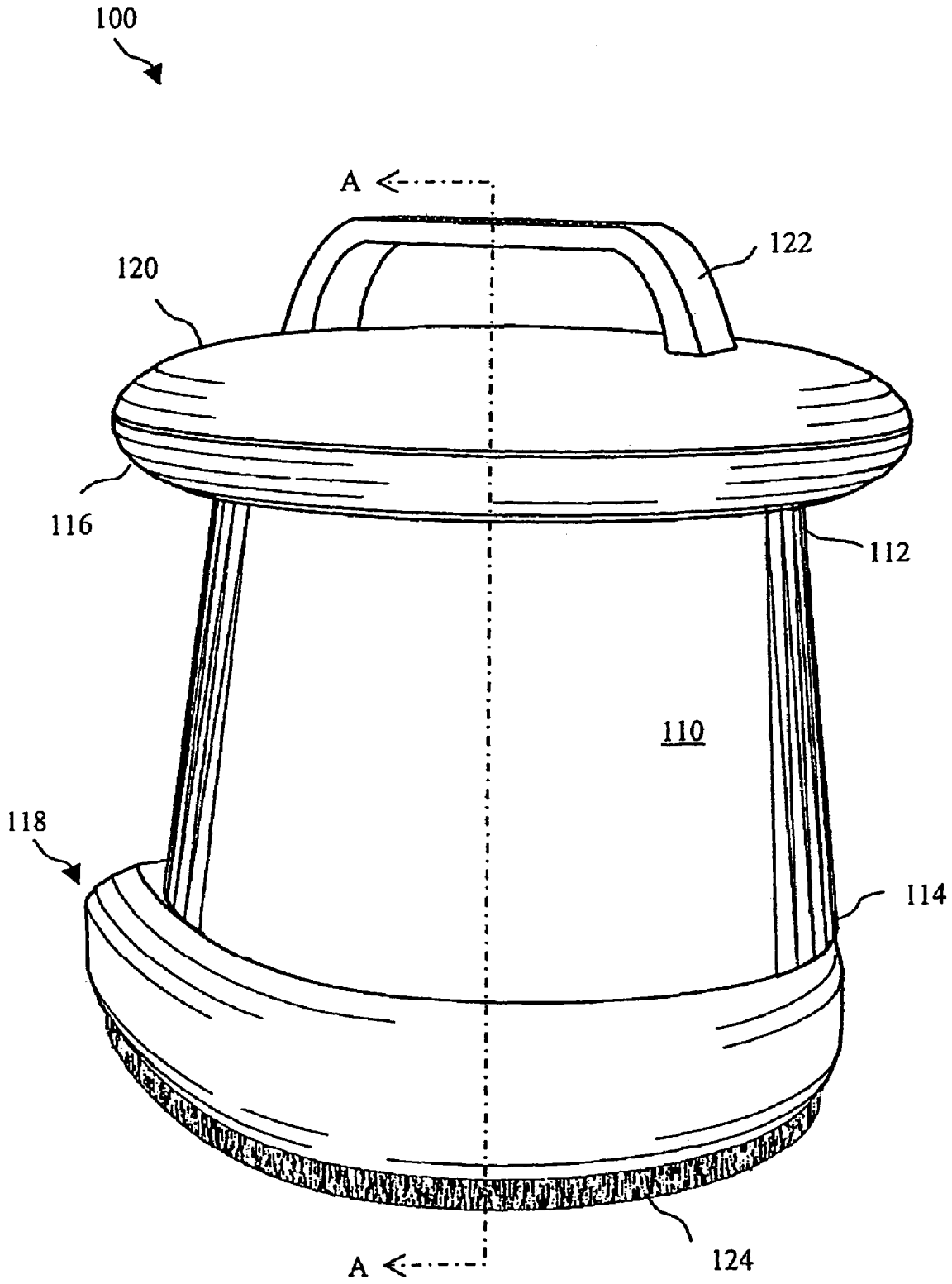
FIG. 1 illustrates a perspective view of a SSR device in accordance with the invention.

FIG. 1 illustrates a perspective view of a forced air SSR device 100, which is representative of a portable device for performing SSR, in accordance with the invention. The device 100 is preferably hand held for ease of use. Forced air SSSR device 100 includes an outer housing 110 that has an outer housing first end 112, which is open, and an outer housing second end 114. A first dust tray 116 is integrated concentrically within the opening of outer housing 110 at outer housing first end 112. At least one corner pickup region 118 is optionally integrated in a protruding fashion within outer housing 110 at outer housing second end 114. More details of optional corner pickup region 118 are shown in reference to FIGS. 2, 3, and 4. In addition to optional corner pickup region 118, there may be other pickup regions at either 90 degrees or 180 degrees from the first optional corner pickup region 118. A removable cover 120 with a handle 122 is preferably installed atop the opening of outer housing 110 and thereby encloses outer housing first end 112 and first dust tray 116. A brush 124 is also preferably integrated along the perimeter edge of outer housing 110 at outer housing second end 114.

Outer housing 110 is substantially cylindrically shaped and is formed of preferably a rigid lightweight material, such as molded plastic, tin, or aluminum. Likewise, first dust tray 116, optional corner pickup region 118, removable cover 120, and handle 122 are formed of a rigid lightweight material, such as molded plastic or aluminum. Removable cover 120 is secured to outer housing 110 by use of standard locking mechanisms that are engaged and disengaged, for example, by the user's rotating removable cover 120 a quarter- or half-turn, relative to outer housing 110, which is held fixed. The implementation of handle 122 is not limited to that shown in FIG. 1. Alternatively, handle 122 may be knob-shaped or may be a handle of standard known shapes, mounted in any ergonomically suitable manner, such as on the side of outer housing 110 opposite optional corner pickup region 118. Alternatively, there may be two handles of standard known shapes located at any point on the side of outer housing 110. Brush 124 is a preferably standard brush formed of a collection of bristles of an appropriate length, stiffness, and density for assisting in dislodging particulates and hair from the soft surface to be cleaned. It may also consist of other materials such as rubber or a composite mixture of various substrates that will allow for the loosening of contaminants and potentially for grooming the soft surface.

Figure 2:
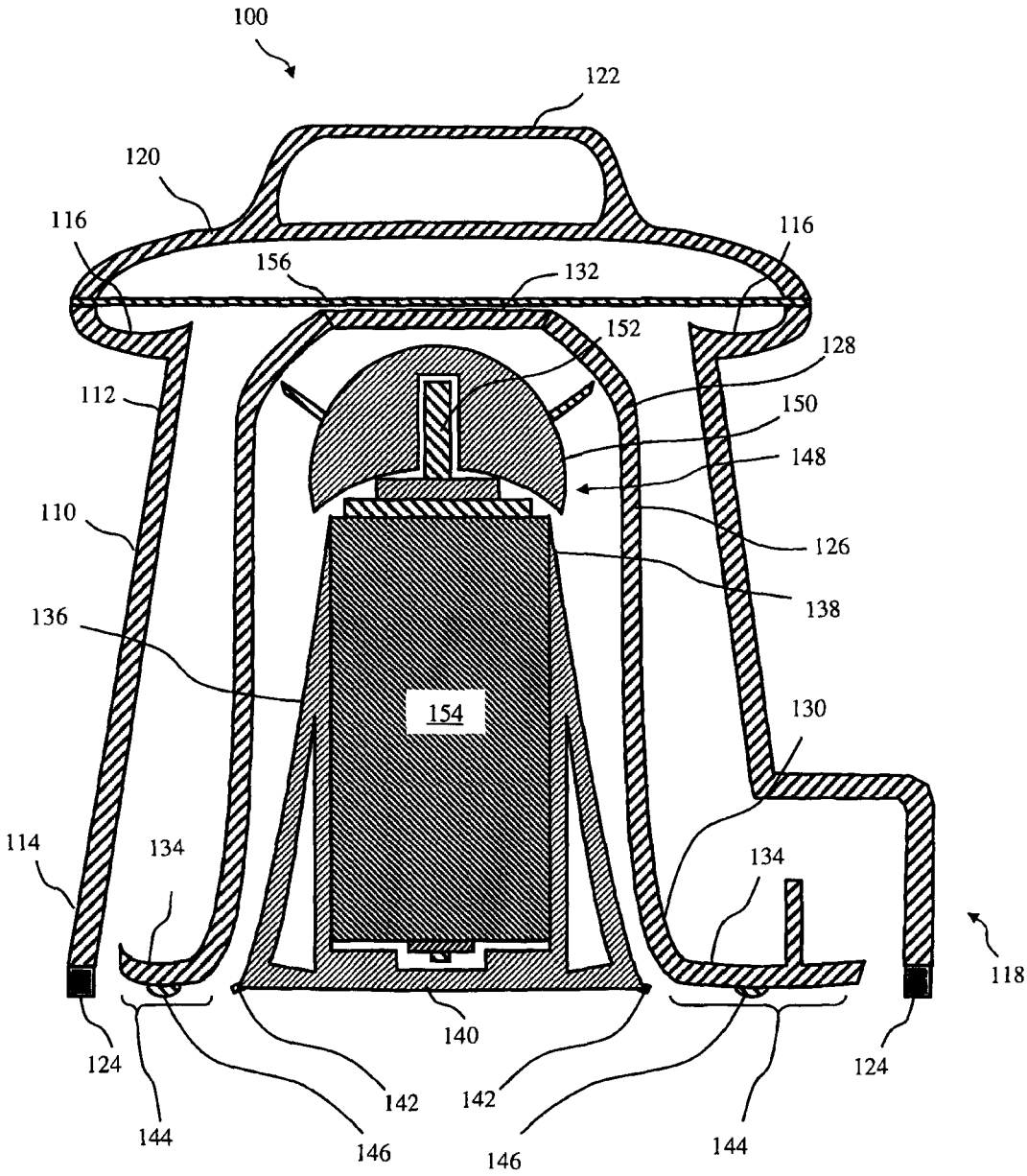
FIG. 2 illustrates the cross-sectional view of the SSR device of the present invention taken along line A-A of FIG. 1.

FIG. 2 illustrates a cross-sectional view of forced air SSR device 100 taken along line A-A of FIG. 1. FIG. 2 shows that forced air SSR device 100 further includes an inner housing 126 arranged substantially concentrically within outer housing 110. Inner housing 126 has an inner housing first end 128 and an inner housing second end 130 that are oriented toward outer housing first end 112 and outer housing second end 114, respectively. Inner housing 126 also includes a top air inlet 132 at inner housing first end 128. A second dust tray 134 is integrated concentrically around the outer circumference of inner housing 126 at inner housing second end 130. Forced air SSR device 100 further includes a motor housing 136 arranged substantially concentrically within inner housing 126. Motor housing 136 has a motor housing open end 138 and a motor housing base plate 140 that are oriented toward inner housing first end 128 and inner housing second end 130, respectively. Motor housing base plate 140 includes a plurality of protrusions or teeth 142 that are evenly spaced around and protrude from its perimeter, as shown. More details of teeth 142 are found in reference to FIG. 4. These protrusions or teeth may be used to grab on and lift up what is on the surface, e.g., pet hair, paper, or even some other electrostatically bound matter. Alternatively, the teeth may be part of a rake, brush, or they may not resemble teeth at all but rather just a soft, spongy piece of material. The teeth may be more rounded to be more like fingers and may be made of plastic, rubber, or some equally stiff yet somewhat flexible material so as not to damage the surface. Inner housing 126 and motor housing 136 are substantially cylindrical shaped and are formed of a rigid lightweight material, such as molded plastic or aluminum. Furthermore, motor housing 136 is somewhat bell-shaped, as motor housing base plate 140 has a larger diameter than motor housing open end 138, as shown in FIG. 2 for air flow and motor cooling reason. FIG. 2 also shows that inner housing 126 has a rounded geometry at inner housing second end 130, in order to form an air restrictor 144 that has a curved surface upon which are mounted a plurality of standoffs 146. More details of air restrictor 144 and standoffs 146 are found in reference to FIG. 4.

Forced air SSR device 100 further includes a fan assembly 148 formed of a fan impeller 150 mounted on a motor shaft 152 of either an alternating current (AC) motor or a direct current (DC) motor 154 that is fitted through motor housing open end 138 and secured within motor housing 136. Fan impeller 150 of fan assembly 148 is preferably oriented toward inner housing first end 128 of inner housing 126.

Fan impeller 150 is a lightweight fan impeller formed of, for example, molded plastic or aluminum. Fan impeller 150 is preferably a highly efficient fan impeller formed by overlapping blades mounted to a spherical hub. Fan impeller 150 is capable of providing high pressure air for a given rotational speed and physical size, as compared with standard fan blade designs. In one example, fan impeller 150 may be a commercially available fan impeller manufactured by Jetfan Technology Limited (Arundel, AU) that uses its JetFan™ technology as described in U.S. Pat. No. 5,620,306, entitled, "Impeller." The '306 patent describes a pressure boost impeller configured for compressing fluids, such as gases and liquids. The impeller of the '306 patent has a front intake area, a rear discharge area, and a hub containing the rotational axis of the impeller. Several blades extend about the hub, with some of the blades being in an overlapping relationship, in order to define a passageway between adjacent blades.

In another example, fan impeller 150 is a mixed flow or "mixflow" fan. A mixflow fan has angled blades that impart some centrifugal direction to the air as it passes through. Closely positioned downstream of the rotating impeller is a row of stationary blades called stators. This stator row has the high speed air flung at it and that air then is slowed by the airfoil action of each stator blade.

Alternatively, the forced air stream may be derived from a conventional source, such as the exhaust fan from a typical vacuum cleaner.

In one embodiment, the preferred motor 154 is a standard low, powered, 6 volt to 24 volt DC motor capable of 5000 to 40000 rotations per minute (RPMs). AC or DC motor 154 may be either a single-speed or multi-speed motor. An example AC motor 154 is Johnson Electric 64335. Fan assembly 148, by the action of AC motor 154 and fan impeller 150, is capable of developing substantial airflow.

Forced air SSR device 100 further includes a collector or separation chamber for removing dust from the air stream. In addition to this collector, an optional catch mechanism 156 mounted at close proximity to top air inlet 132 of inner housing 126 and parallel to removable cover 120 at outer housing first end 112 of outer housing 110. The mechanism 156 is preferably a consumable non-woven filter, electrostatic cloth or other such material positioned in close proximity to fan impeller 150. Such a disposal mechanism or catch 156 may be a variety of shapes, including, but not limited to, a J-ring, a donut, or a slightly convex or concave cup. The disposal catch mechanism 156 is, for example, a non-woven material that acts like a filter for the air circulating within the device 100. The filter may be supported by a plastic or cardboard ring, frame, or housing. In another example, disposal catch mechanism 156 is a Grab-It® Cloth from S.C. Johnson & Son, Inc. (Racine, Wis.) or a Swiffer® Cloth from Procter & Gamble (Cincinnati, Ohio). Alternatively, the disposal catch mechanism 156 is an easily removable and recyclable HEPA filter or some other fine particle filter. In yet another example, disposal catch mechanism may be located on or in the first dust tray 116 and may be a non-woven material, a gel, or some sticky substance that will act to trap and hold particulate matter within the air. Examples of possible catches are shown in FIGS. 17A-26. These will be more fully explained below.

Disposal catch mechanism 156 may be also impregnated with an active material or ingredient to provide sanitation, such as, odor removal, odor neutralization, or dust mite control, to the soft surface to be cleaned. An example active ingredient for providing sanitation and that has suitably small particles that do not saturate the fabric is triethylene glycol (TEG). An example active ingredient for providing odor neutralization is also triethylene glycol (as found in Oust® from S.C. Johnson & Son). An example active ingredient for providing odor removal is cyclodextrin (as found in Febreze® from Procter & Gamble). Alternatively, the material may be added directly into the air flow within the device through a delivery system, e.g., an integral reservoir configured to release chemistry into the inside of the housing. The chemistry may include the following: cleaners, odor eliminators, fresheners, protectants, and disinfectants all of which may be in the form of liquids, gases, solids, gels and/or powders or combinations thereof. This chemistry is suitable to remediate hard and soft surfaces such as a pillow, mattress, carpet, car interior, drape, window, floor, plumbing drain, insect habitat, and/or couch.

Additionally, any active material or ingredient may be delivered to the surface being treated by the use of a reservoir 205 (as shown, e.g., in FIGS. 7 and 8) or other system that is externally mounted to the unit, and which may include a trigger spray, pump spray, aerosol, or similar means. Alternatively, the material may be a foam cleaner (contained e.g., in a canister) which after being first set down by an outward flow is then picked up by the device. The foam may be activated by a variety of means as is known in the art, e.g., chemical reaction, surfactants, agitators, a dual bottle system, OXY-CLEAN, etc.

Materials that both protect and renew also may be added to the fluid stream. These materials can rejuvenate the fibers of the soft surface and coat them to become more dirt resistant and water resistant in the future. For example, various compositions made by DuPont and 3M are known to make fabric water and/or stain resistant, such as SCOTCHGUARD™.

These materials may also include compositions comprised of a dispersant and/or microcapsules containing an active material.

Forced air SSR device 100 further may include a battery assembly (not pictured) formed of a plurality of batteries (not pictured), which are standard rechargeable or non-rechargeable batteries that are electrically connected to provide a DC voltage source of 6 to 24 volts to DC motor 154. Alternatively, the device may be corded and operate via an AC voltage source.

The overall dimensions of forced air SSR device 100 are, for example, a diameter of between about 4 and 12 inches (approximately 10-26 cm) and a height of between and 6 and 12 inches (approximately 15-26 cm). Additionally, an example weight of forced air SSR device 100 is between 2 and 5 lbs (approximately 0.9-2.7 kg). The overall dimensions and weight of forced air SSR device 100 are not limited to those stated above, so long as they are practically suited to an easy to hold and use, portable device. Preferably, such a device 100 is ergonomically friendly to the user.

With continuing reference to FIGS. 1 and 2, those skilled in the art will recognize that forced air SSR device 100 includes standard mechanical mounting structures for securing removable cover 120, inner housing 126, motor housing 136, fan assembly 148, disposal catch mechanism 156, and battery assembly (for the DC powered version) but, for simplicity, are not shown.

Figure 3:
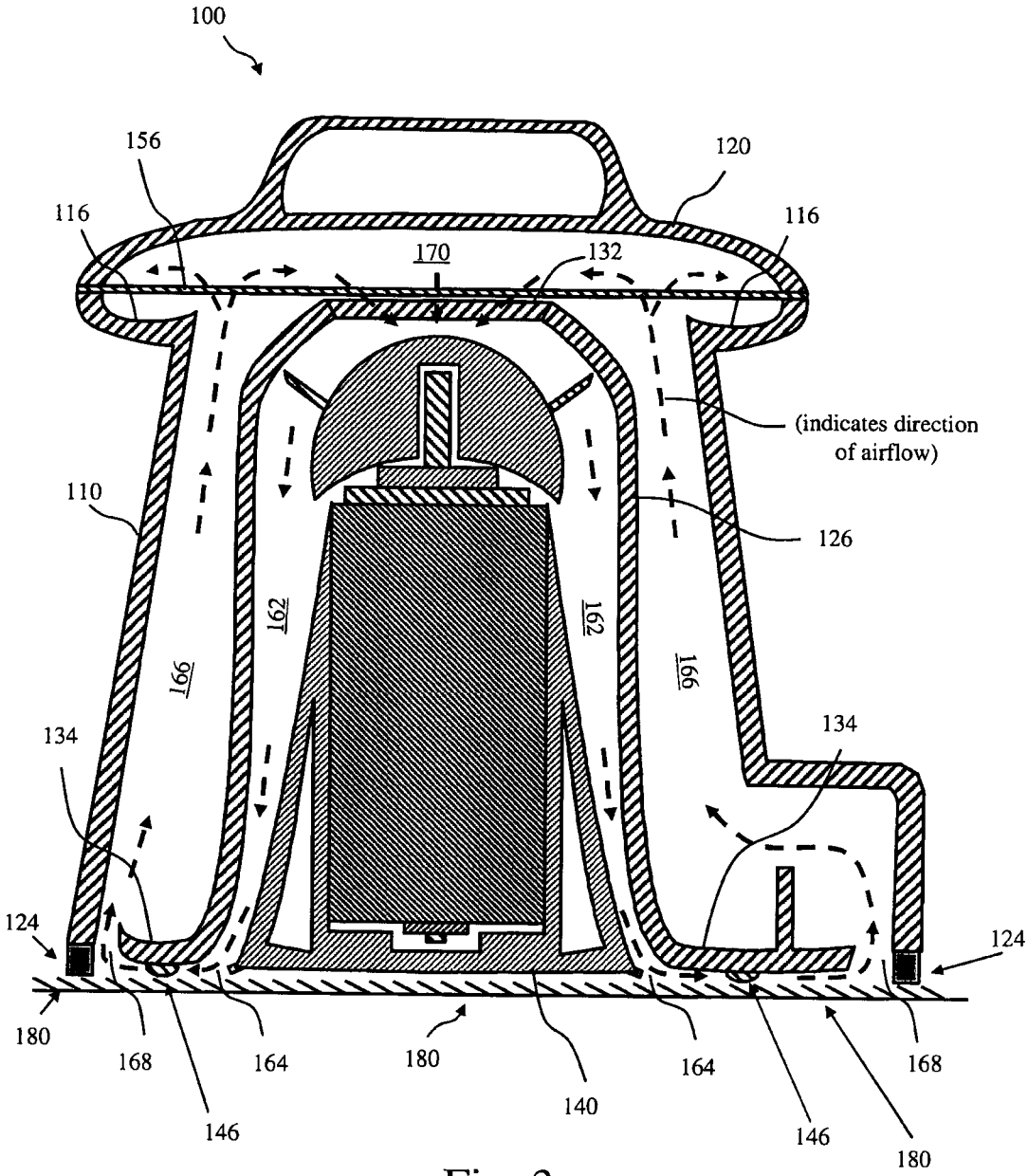
FIG. 3 again illustrates the cross-sectional view of the SSR device of the present invention taken along line A-A of FIG. I and also indicates airflow within the forced air SSR device when in use.

FIG. 3 again illustrates the cross-sectional view of forced air SSR device 100 taken along line A-A of FIG. 1 for indicating airflow within forced air SSR device 100 when in use. FIG. 3 shows that forced air SSR device 100 further includes a first air channel 162, which is an air cavity formed around the circumference of motor housing 136 between an outer wall of motor housing 136 and an inner wall of inner housing 126. First air channel 162 has a bottom air outlet 164 around the circumference of motor housing 136, where motor housing base plate 140 is in close proximity to the inner wall of inner housing 126 at inner housing second end 130. Additionally, a second air channel 166 is an air cavity formed around the circumference of inner housing 126 between an outer wall of inner housing 126 and an inner wall of outer housing 110. Second air channel 166 has a bottom air inlet 168 around the circumference of inner housing 126, where the outer wall of inner housing 126 at inner housing second end 130 is in close proximity to the inner wall of outer housing 110 at outer housing second end 114. A return air channel 170 is an air cavity formed in close proximity to disposal catch mechanism 156, between removable cover 120 and top air inlet 132 of inner housing 126. Air circulates through the channels 162, 166, and 170. Air may also be moved to the outside toward the outer housing wall and thus allowing dust to settle in first dust tray 116. Additionally, FIG. 3 shows brush 124 and standoffs 146 of forced air SSR device 100 contacting a soft surface 180, which is representative of any soft surface to be cleaned, such as upholstery. More details of the portion of forced air SSR device 100 that contacts soft surface 180 are found in reference to FIG. 4.

Figure 4:
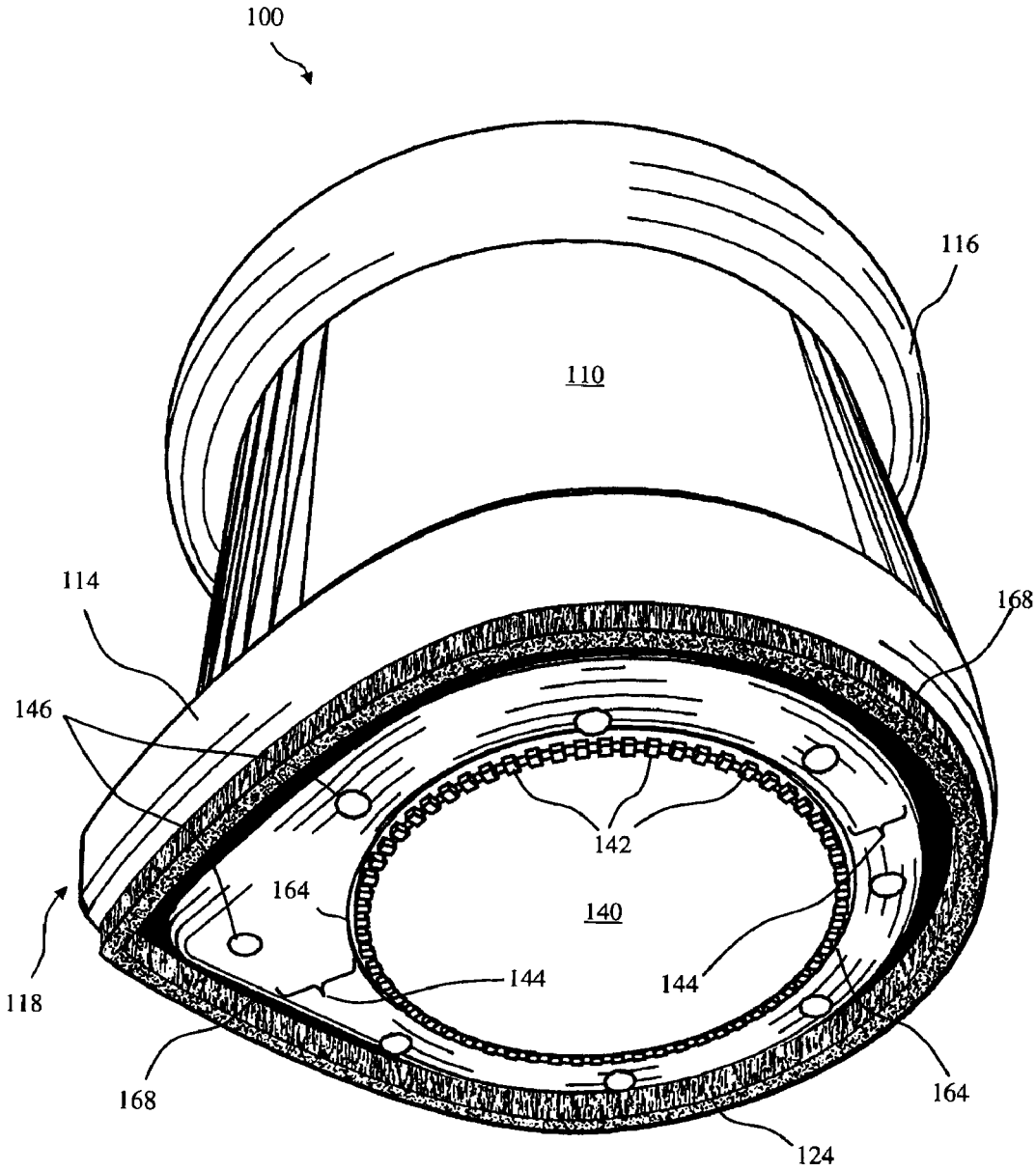
FIG. 4 illustrates a bottom perspective view of the SSR device of the present invention.

FIG. 4 illustrates a bottom perspective view of forced air SSR device 100. FIG. 4 shows the plurality of teeth 142 spaced evenly around and protruding from the perimeter of motor housing base plate 140. FIG. 4 also shows the set of standoffs 146 spaced evenly around and protruding from the surface of air restrictor 144, which is slightly rounded. Additionally, FIG. 4 shows optional corner pickup region 118 forming a 90 degree structure at outer housing second end 114 of outer housing 110 in what is, otherwise, a circular cross section. Brush 124 is installed along the outermost perimeter of outer housing second end 114 of outer housing 110 that includes optional corner pickup region 118.

Referring back to FIG. 4, motor housing base plate 140, teeth 142, air restrictor 144, and standoffs 146 are formed of a rigid lightweight material, such as molded plastic or aluminum. Optionally, the outer surface of motor housing base plate 140 may be covered with a lint or pet hair pickup up cloth or pad, which is another consumable item that is replaced, as needed. Standoffs 146 and teeth 142 are suitably sized and shaped to avoid snagging on the fabric of soft surface 180. Standoffs 146 protrude from the surface of air restrictor 144 and are, for example, 1 to 10 mm in length and 1 to 15 mm in diameter. Teeth 142, which are optional, protrude at an angle to motor housing base plate 140 and are, for example, 1 to 5 mm in length and 0.25 to 5 mm in diameter. Also shown are bottom air inlet 168 around the circumference of inner housing 126 and bottom air outlet 164 around the circumference of motor housing base plate 140, whereby air restrictor 144 serves as the airflow interface there between. Standoffs 146 ensure that air restrictor 144 is maintained at the appropriate distance and slightly separated from soft surface 180 and, thus, an airflow path between air restrictor 144 and soft surface 180 is ensured.

With continuing reference to FIGS. 1 through 4, the preferred operation of forced air SSR device 100 is as follows. The removal cover 120 is removed. A clean disposal catch mechanism 156 is installed within outer housing 110 of forced air SSR device 100, in close proximity to first dust tray 116 and in the path of return air channel 170. The removable cover 120 is replaced. The removable cover 120 includes an optional locking feature that prevents the unit from operating if the removable cover 120 is not locked into place. Forced air SSR device 100 is activated by a standard on/off switch (not shown) that makes an electrical connection between the output voltage of battery assembly and DC motor 154 or from a home's electrical-power outlet to the AC motor 154 As a result, fan impeller 150 rotates and creates a flow of air by drawing air into top air inlet 132 of inner housing 126, through first air chamber 162 and exiting bottom air outlet 164, passing around air restrictor 144, returning through bottom air inlet 168 and into second air channel 166, passing through disposal catch mechanism 156 and into return air channel 170, and returning back into top air inlet 132 to preferably form a closed loop system within forced air SSR device 100, which is a closed unit. Furthermore, the airflow from bottom air outlet 164, around air restrictor 144, and into bottom air inlet 168 is enhanced by a phenomenon known as the Coanda effect, which is the tendency of a stream of fluid to follow a convex surface, rather than follow a straight line in its original direction. For example, because of the Coanda effect, some of the stream of pressurized air emerging from bottom air outlet 164 tends to follow the nearby curved surface of air restrictor 144. The remainder of the air will be directed toward the surface, loosening and dislodging the dirt, dust, odor molecules, particulate matter and whatever else might be trapped on or within the surface.

The user then preferably brings brush 124, motor housing base plate 140, and standoffs 146 into contact with the surface to be cleaned, such as soft surface 180, as shown in FIG. 3, and moves forced air SSR device 100 over soft surface 180 by using any back-and-forth or side-to-side motion. In doing so, pressurized air is released through bottom air outlet 164 and impinges upon soft surface 180. This high pressure is created by the action of fan impeller 150 and the narrowing of first air channel 162. For example, this is in part due to the bell shape of motor housing 136 that helps form a narrow bottom air outlet 164. The combination of pressurized air exiting bottom air outlet 164 and the action of brush 124 and teeth 142 impinging upon soft surface 180 serves to dislodge contaminants, typically in the form of particulates and hair, from soft surface 180. These loose contaminants are caught either in the airflow of forced air SSR device 100 and are, consequently, carried into bottom air inlet 168 for collection within forced air SSR device 100. Moving forced air SSR device 100 over soft surface 180 is effectively moving an air stream, which is gathering contaminants, over its surface. More specifically, contaminants that are dislodged by the pressurized air are drawn into second air channel 166, wherein any particles that are too heavy to flow the full distance of second air channel 166 to disposal catch mechanism 156 fall, because of gravity, into second dust tray 134. The remaining contaminants are drawn the full distance of second air channel 166, wherein some additional particles are preferably captured within first dust tray 116 and the smallest contaminants are captured within disposal catch mechanism 156. Filtered air flows through return air channel 170 onto top air inlet 132 of inner housing 126 and returns to fan impeller 150. The air within return air channel 170 circulates in a cyclonic manner and, thereby, flings some particles outwardly and into first dust tray 116. Additionally, any active ingredient that is impregnated within disposal catch mechanism 156 is delivered into the airflow of first air channel 162 by the action of fan impeller 150 and, subsequently, driven into the fabric of soft surface 180 via bottom air outlet 164. Additionally, any cleaning fluids or other active ingredients may be delivered to the surface being treated by the use of a device that may be mounted internally in or externally to the device 100. Such delivering mechanism may include a trigger spray, pump spray aerosol, or similar means of delivering active ingredients, e.g., chemistry, to the surface being treated.

Figure 5A:
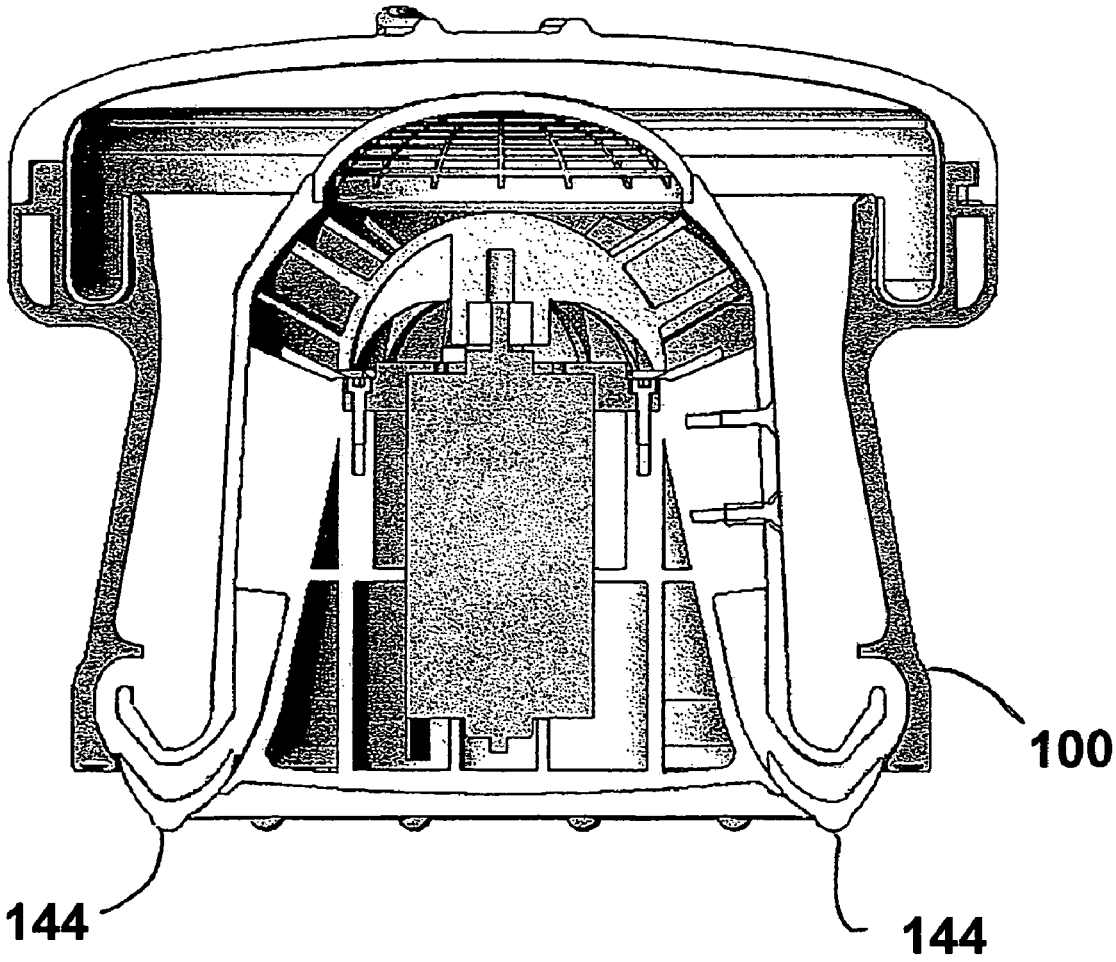
FIGS. 5A and 5B illustrate a cut away view of another embodiment having a moving trap mechanism;.
Figure 5B:
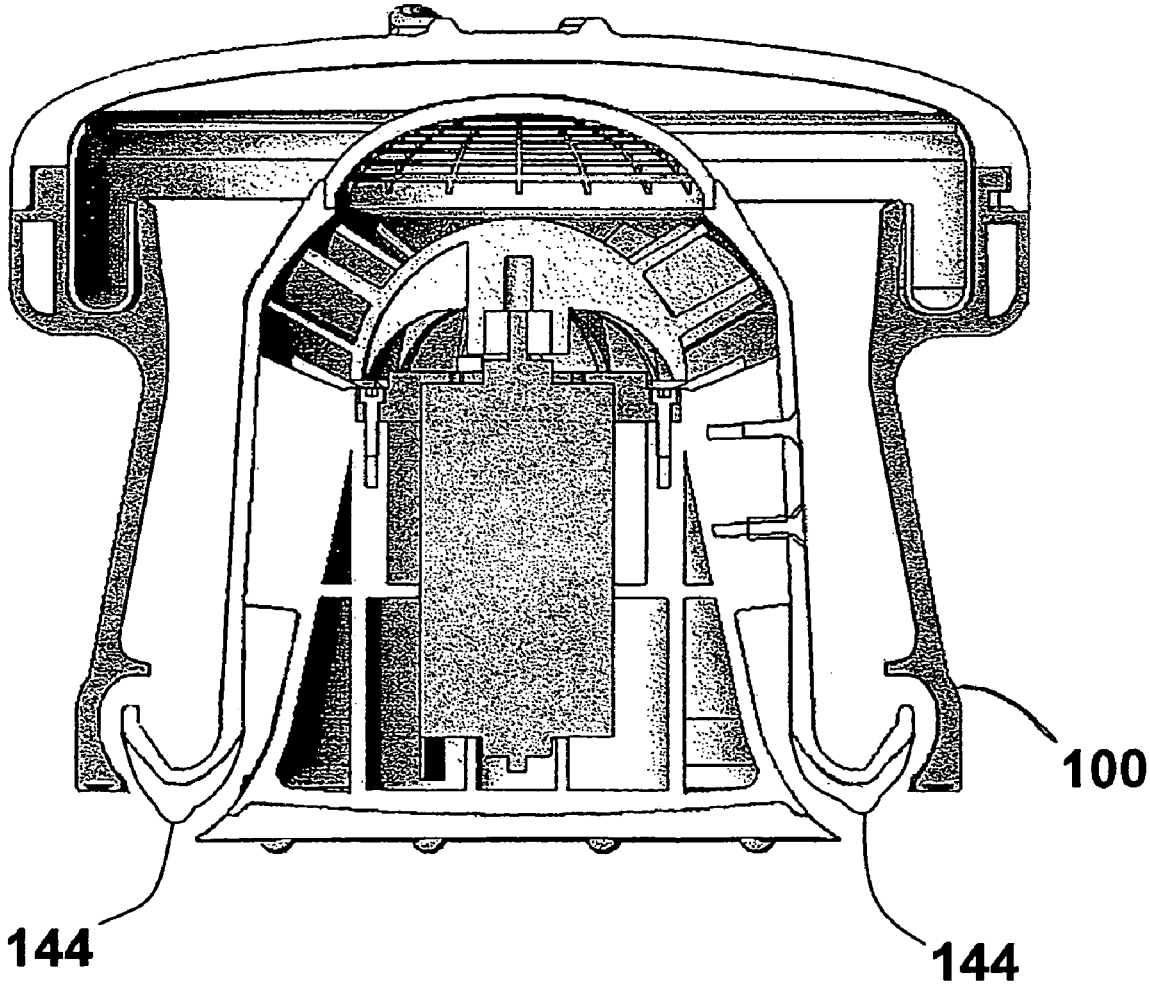

The embodiment of the inventive device 100 shown in FIGS. 5A and 5B illustrates that air restrictor 144 may be a moveable, annular member that, when in its upper position, allows the unit to function as defined. When this member 144 or trap is pulled down preferably by gravity to its lower position (FIG. 5B), it diverts the air between itself and the surface above it. The reason is that before the device 100 is placed on the surface to be cleaned the descending air jet disturbs the dirt and scatters it. This member prevents this by allowing the device 100 to approach the surface and the weight of the device 100 or the operator's down force pushes or moves it vertically up into the operating position. The trap 144 may be moved downward by either gravity or a spring device. In another embodiment, this member may be biased by a spring or similar such mechanism. Alternatively, this member may be linked to a secondary switch that rotates the fan once it is in contact with the surfaces. Note this embodiment shown in FIG. 5A and 5B does not show the optional corner pickup region.

Figure 6:
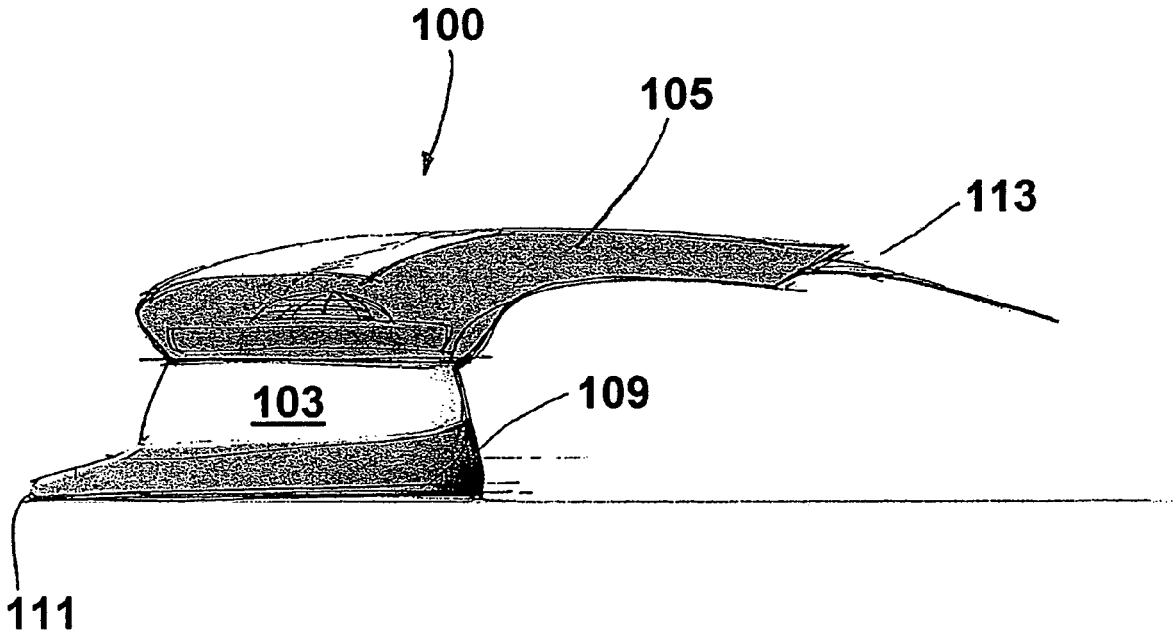
FIG. 6 illustrates a side view of another embodiment of the present invention.

In another embodiment as best shown in FIG. 6, the device preferably has a long, extendable handle 105 connected to a body 103. This device 100 preferably has a window 107 on a top side for viewing the inside of the body 103. It also has a rubber bumper 109 at a rear side to protect items which be bumped by the device 100 during use. An extended nose 11 1 is preferably also included. This embodiment is preferably power through an electrical cord 113. Because of it configuration, this device 100 may be used not only for soft surface cleaning but with minor modification to deliver material that includes an insecticide, repellant, herbicide, fungicide, antimicrobial, floor cleaner, window cleaner, drain cleaner, air freshening, etc. A long, extendable, preferably telescoping, handle allows the user to reach certain surfaces and/or provide distance between the user and the material treating the surface during application. In some instances, the motor is preferably impervious to water so that the device can be used in areas where these types of liquids are used.

Figure 7:
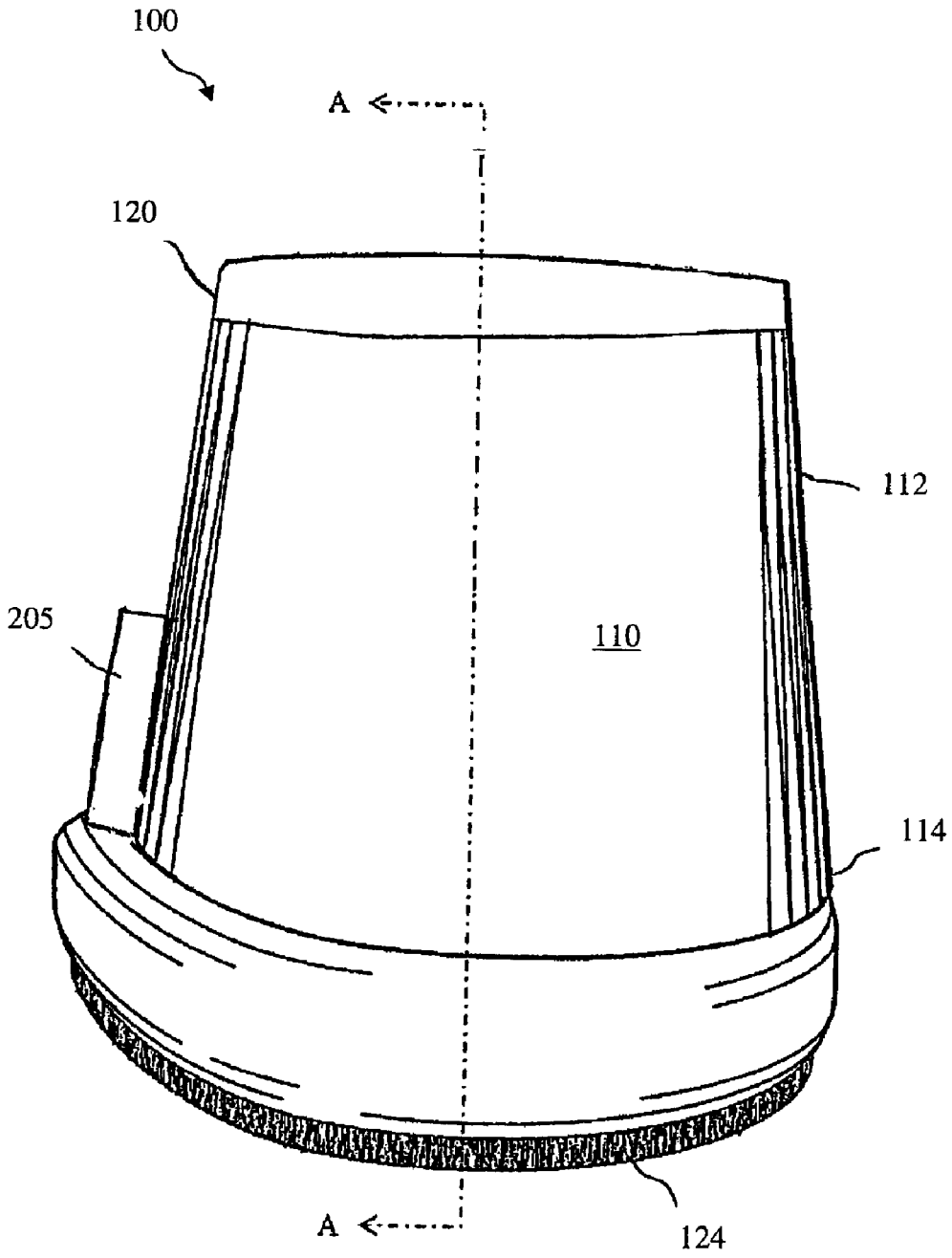
FIG. 7 illustrates a front perspective view of another possible embodiment of the device of the present invention.
Figure 8:
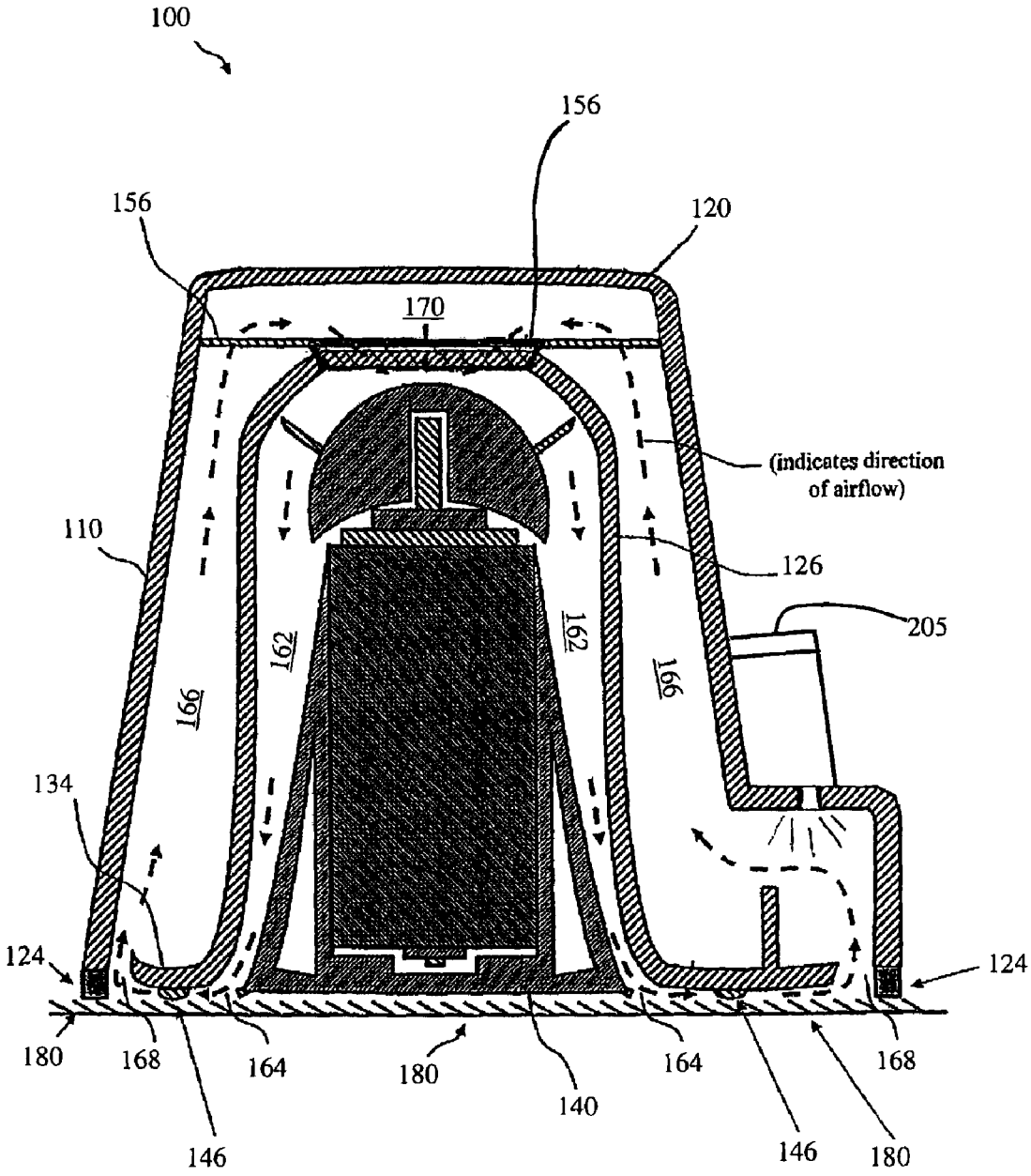
FIG. 8 is a cross sectional of the embodiment of FIG. 7.

FIGS. 7 and 8 show another embodiment of the present invention. Noticeably absent from the device 100 of this embodiment are the handle and the bulbous first dust tray housing. A removable cover 120 is preferably attached to housing 1 10. A fluid reservoir 205 is preferably attached This embodiment is configured to fit into the palm of the user's hand for ease of use in touch-up cleaning particular in areas where is there is not much space. Air flow in this embodiment is limited to the channels 162, 166, and 170. This embodiment may have a corner pick up region 118 but one is not necessary and debris can be collected in the disposal catch mechanism 156 that fits into the return air channel 170. A dislodging mechanism or brush 124 may be present below the outer housing second end 114. The dislodging mechanism 124 shown here may also include a brush, a duster, elastic fingers, a stiffer brush for pet hair removal, etc.

Figure 9B:
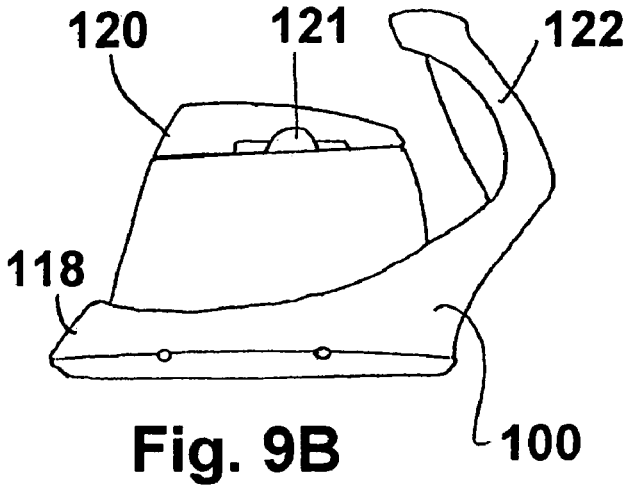
FIG. 9B illustrates a side view of the embodiment of FIG. 9A.
Figure 9A:
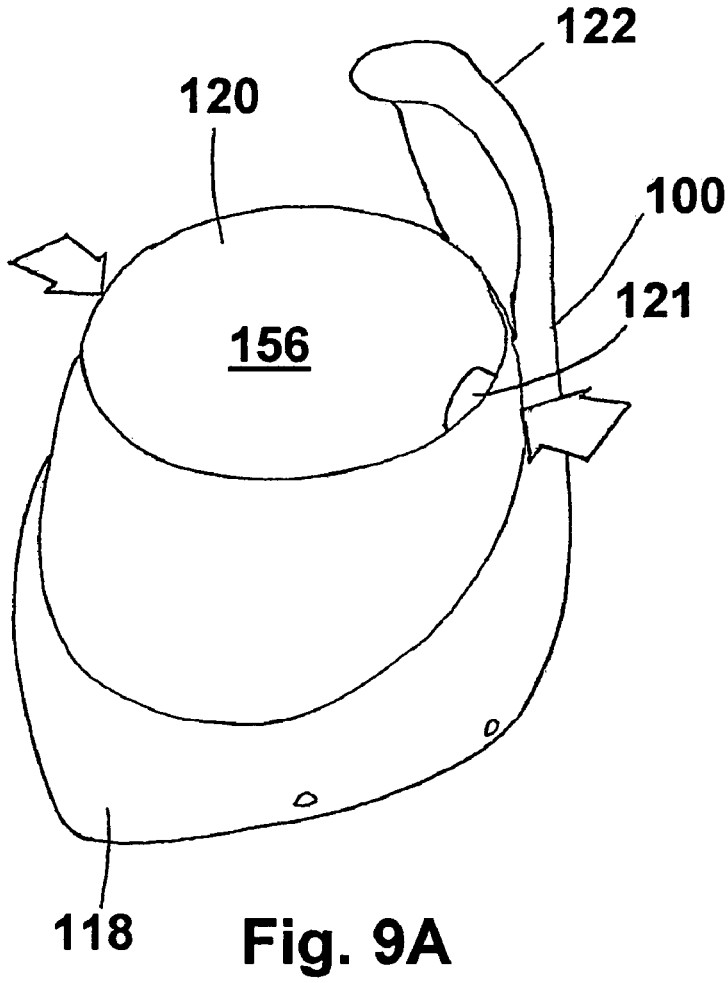
FIG. 9A illustrates another possible embodiment.

FIGS. 9A-10B show many additional embodiments of the present invention. FIGS. 9A and 9B show a device 100 having a front corner pick-up region 118 for getting into tight corners or small spaces. A clear cover 120 preferably is attached to the top so that a user can see when the unit is full of debris and the filter 156 needs changing. Textured areas 121 on the sides of the cover 120 act as lock releases so that when pushed inwardly (as shown by the arrows), the cover can be removed and the filter changed. A longer rectangular shaped handle 122 protrudes from a rear of the body of the device 100. The handle 122 preferably has a textured and cushioned grip 123.

Figure 9D:
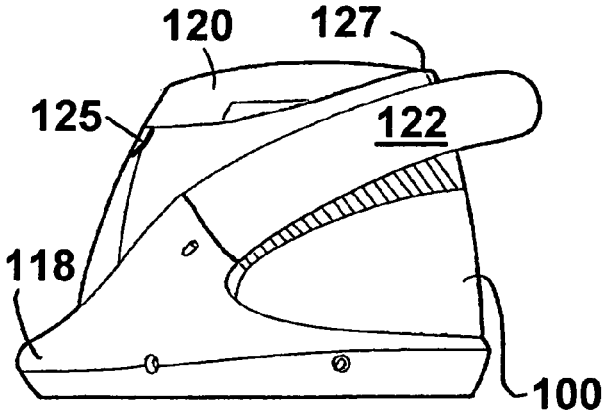
FIG. 9D illustrates a side view of the embodiment of FIG. 9C.
Figure 9C:
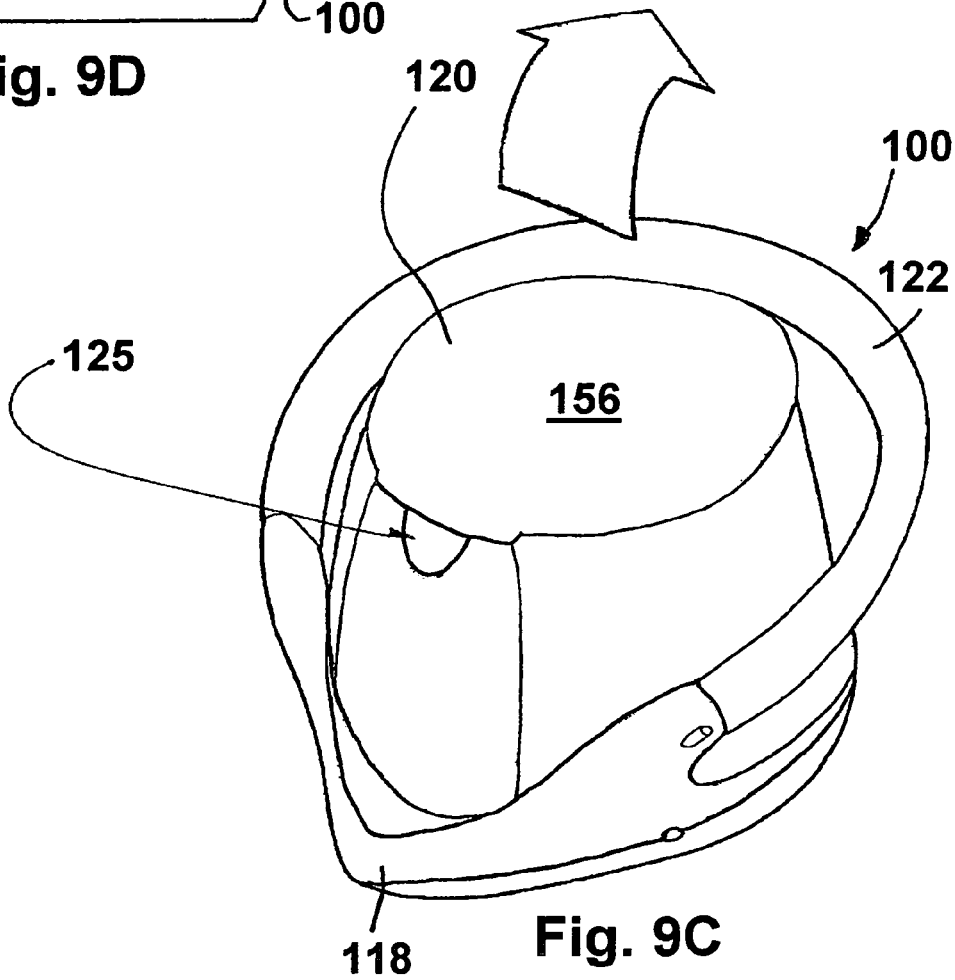
FIG. 9C illustrates Still another possible embodiment.

FIGS. 9C and 9D show yet another embodiment of the inventive device 100 having a front corner pick-up region 118. A clear cover 120 preferably is attached to the top. A button 125 on the front of the cover triggers a latch and allows the cover to be opened. The cover 120 preferably rests on a hinge 127 so the cover opens like a clamshell (as indicated by the arrow) and the debris inside can be dumped into a garbage container. A longer, circular handle 122 wraps around the body of the device 100. Handle 122 is covered with a spongy rubber material to provide a textured and cushioned grip.

Figure 9F:
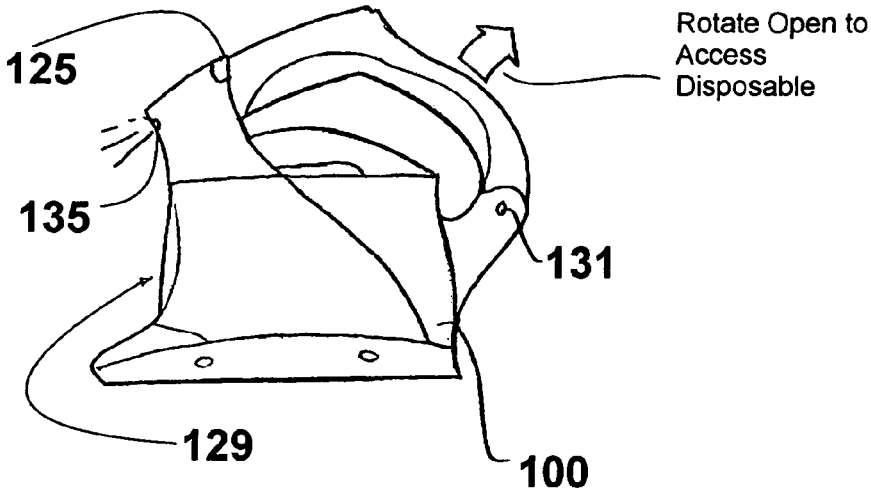
FIG. 9F illustrates a side view of the embodiment of FIG. 9E.
Figure 9E:
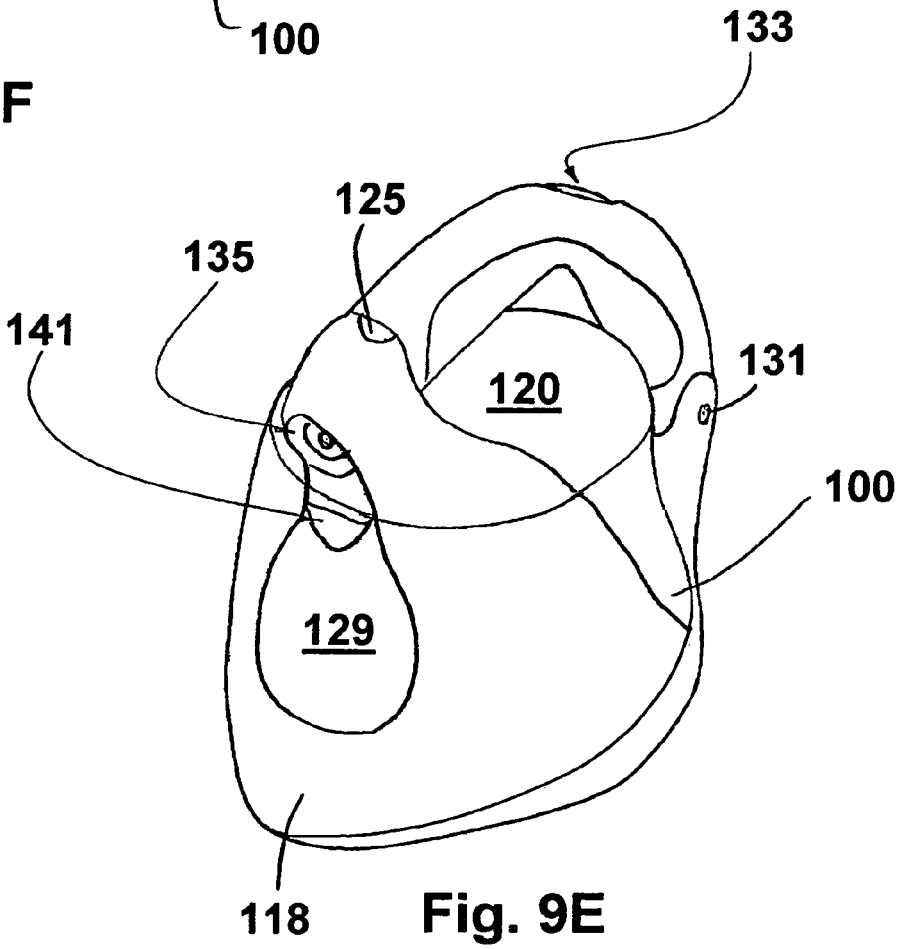
FIG. 9E illustrates yet another possible embodiment.

FIGS. 9E and 9F show yet another embodiment of the inventive device 100 having a front corner pick-up region 118. A door 129 may be at a front of the body. A clear cover 120 preferably is attached to the top but it is secured by a semi-circular handle 122 that fits over the top of the cover as shown. The handle is attached at a pivot point 131. A button 125 on the front of an outer housing extension releases a latch and allows the handle 122 to swing back and opened as indicated by the arrow) so that fluid may be placed in a reservoir contained therein. A button 133 on a rear of handle 122 acts as a trigger to disperse a fluid from a front of the device through an orifice 135. This mechanism is similar to that of a traditional clothes iron that disperses water. Handle 122 is covered with a spongy rubber material on an underside to provide a textured and cushioned grip. Button 141 allows the door 129 to be opened so that debris trapped in a cavity within the body can be emptied.

Figure 10A:
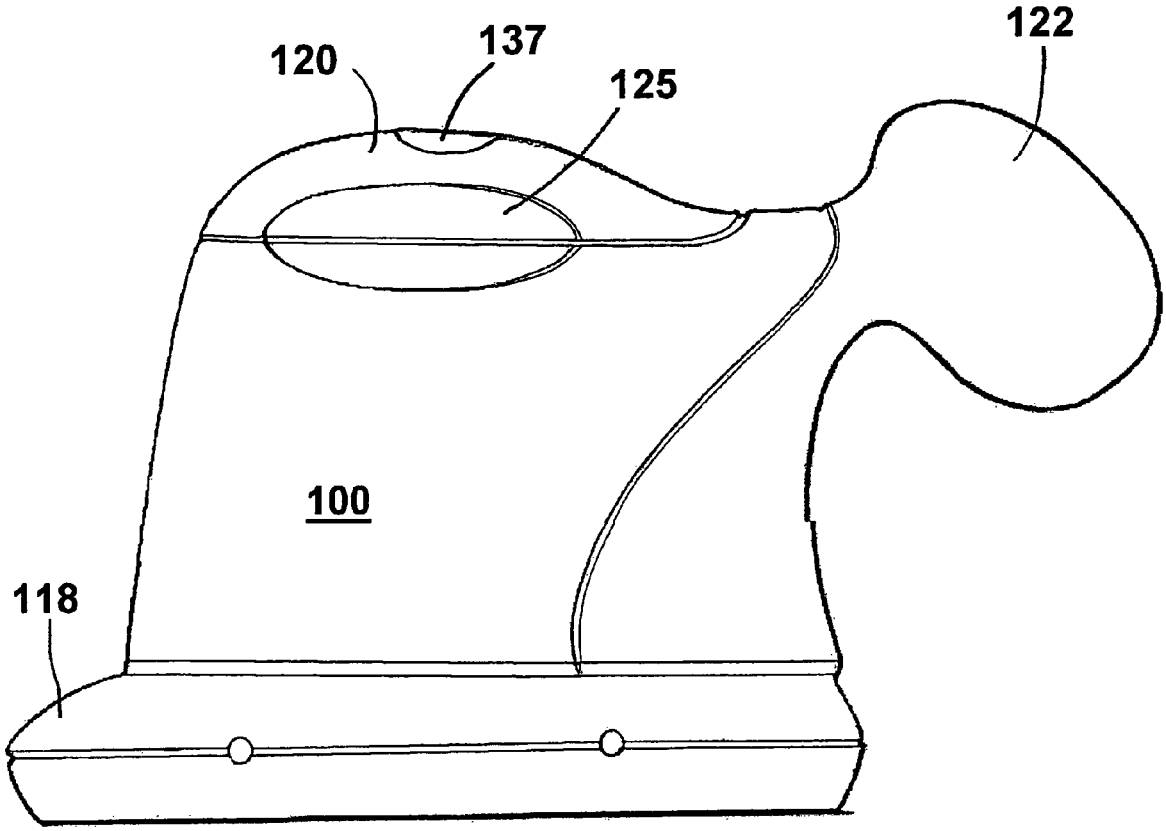
FIG. 10A illustrates a side view of another possible embodiment.

FIG. 10A shows still another embodiment of the inventive device 100 having an elongated front corner pick-up region 118. A cover 120 preferably is attached to the top and it has a window 137 to see a filter there below. A button 125 on the side of the cover triggers a latch and allows the cover 120 to be opened. The cover 120 preferably rests on a hinge so the cover opens like a clamshell. A smaller, knob-like handle 122 is attached to the rear of the body of the device 100. Again, handle 122 is covered with a spongy rubber material to provide a textured and cushioned grip.

Figure 10B:
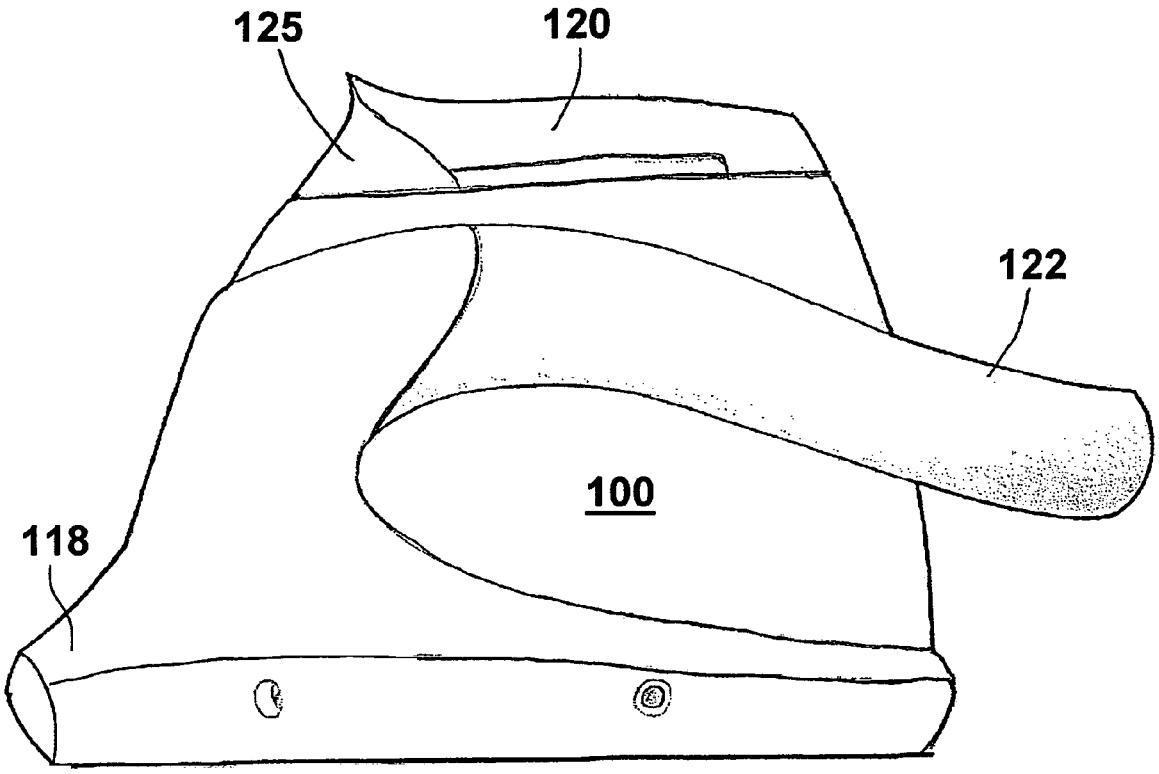
FIG. 10B illustrates a side view of another of the embodiment.

FIG. 10B shows another embodiment of the inventive device 100 having a shorter front corner pick-up region 118. Again, cover 120 preferably is attached to the top. A button 125 on the front of the cover triggers a latch and allows the cover 120 to be opened. The cover 120 preferably rests on a hinge so the cover opens like a clamshell. A longer, low swooping handle 122 is attached to the front of the body of the device 100 and is covered with a material to provide a textured and/or cushioned grip.

Figure 12A:
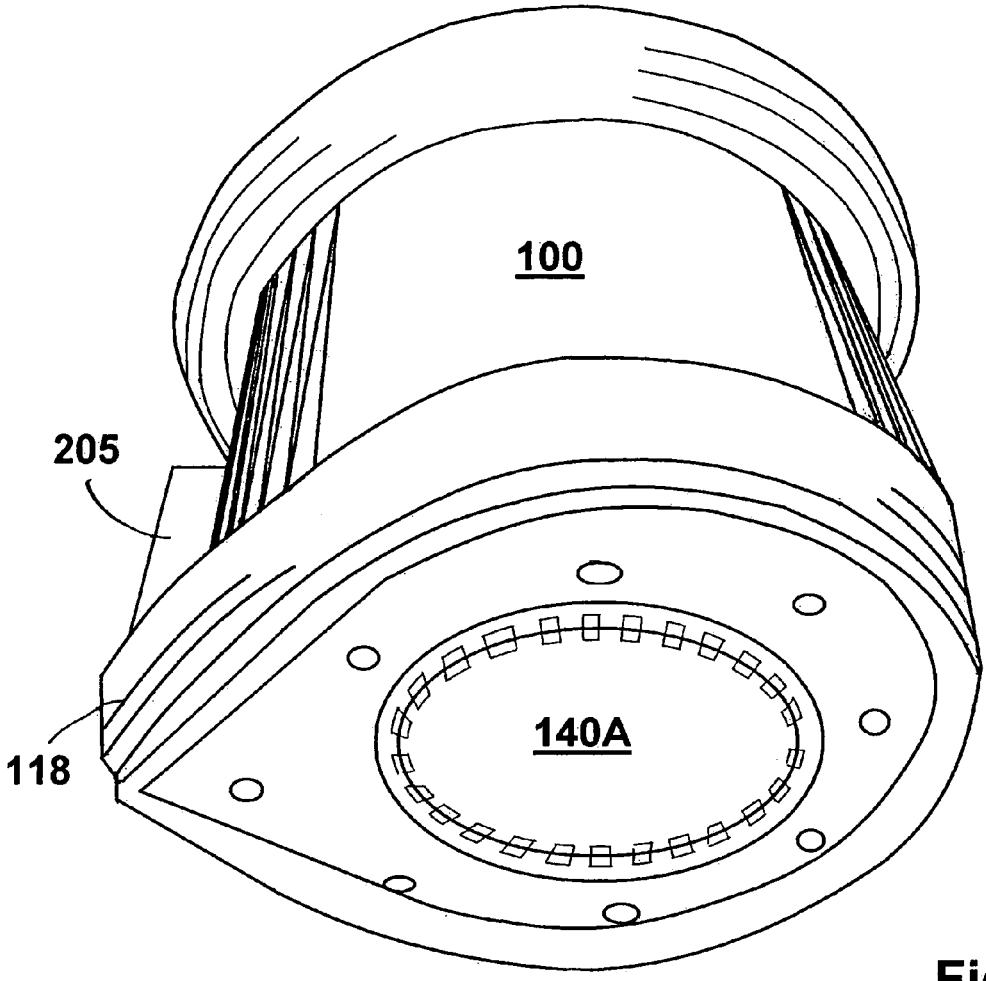
FIG. 12A illustrates yet another possible embodiment similar to the embodiment shown in FIG. 7.
Figure 12B:
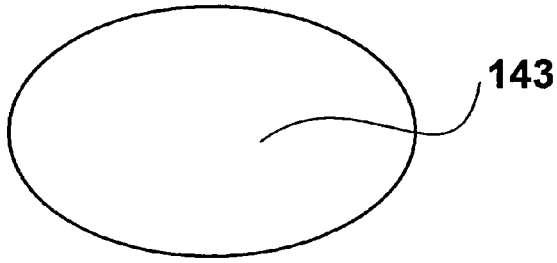
FIG. 12B illustrates a bottom magnified view of part of the embodiment shown in FIG. 11A.
Figure 12B:
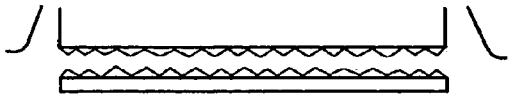
Figure 13:
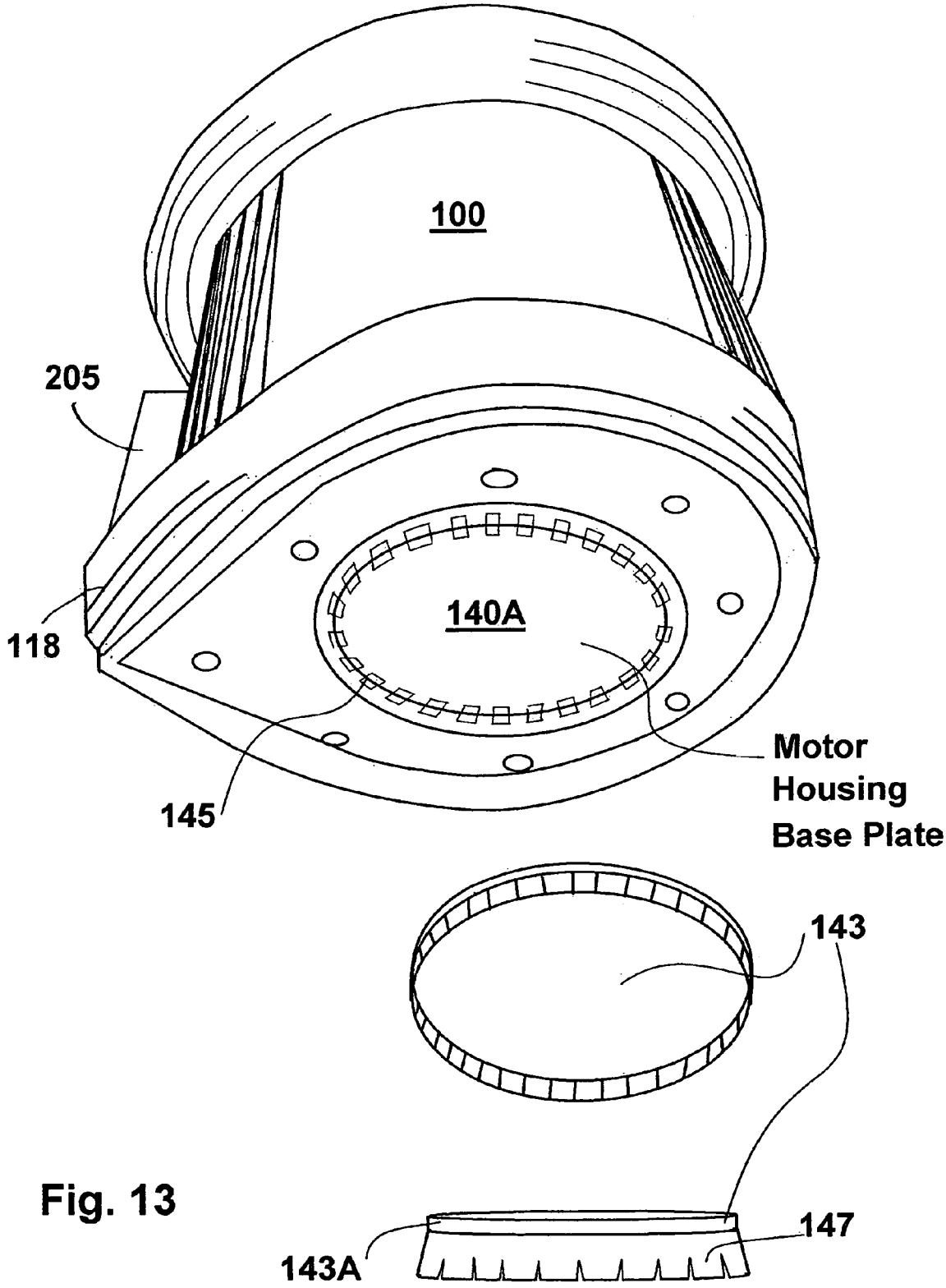
FIG. 13 illustrates another possible embodiment.

In the embodiments shown in FIGS. 11A-13, additionally a lint cloth or pad, a scrubby cloth or pad or other similar devices 143 may be attached to the motor housing bottom 140A to act as a particulate matter remover. These alternative pads may be changed in and out of the device and cleaned depending on the task at hand. U.S. Pat. No. 6,550,092 describes in detail a cleaning sheet that may be modified to act as a pad 143 for this purpose. Also, these may include items that may be thrown away after use. In some of these embodiments, the teeth protrusions 142 may be replaced by such a pad as best shown in FIG. 13. In this embodiment the replaceable element 143 may consist of a paper like disposable ring 143A having protrusions 147 sticking out of it that fits into a channel 145.

Figure 11A:
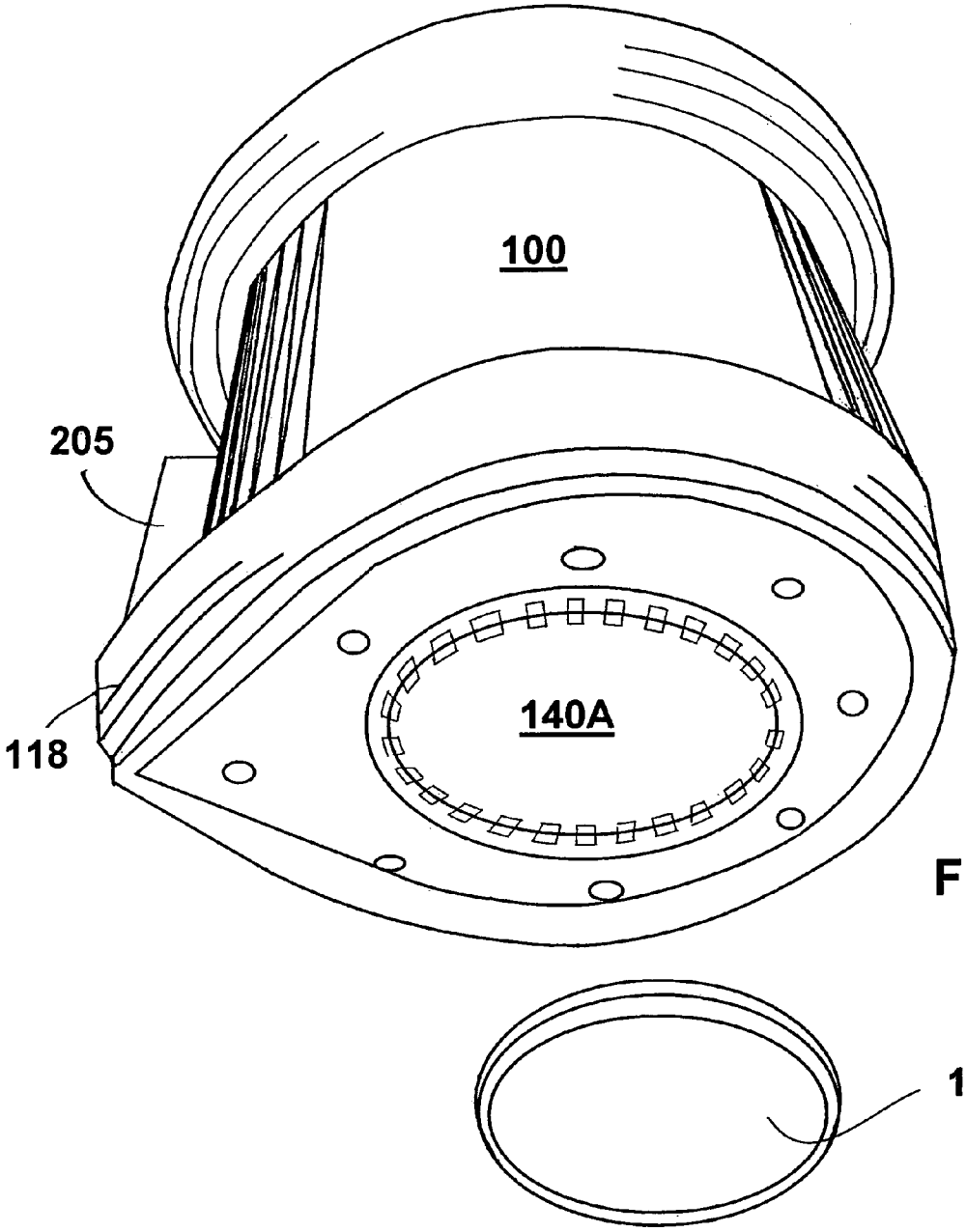
FIG. 11A illustrates yet another possible embodiment similar to the embodiment shown in FIG. 7.
Figure 11B:
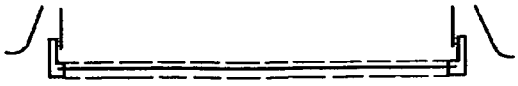
FIG. 11B illustrates a bottom magnified view of part of the embodiment shown in FIG. 11A.

Specifically, FIG. 11 A shows a consumable that is held within a ring made of appropriate material so that the ring stretches the consumable "fabric" or mesh (could be non woven cloth, plastic, rubber composite or other combinations thereof) and snap fits or uses another means to attach to the outer lip of the motor housing base plate. The consumable is taken out of the package and then pressed onto the bottom of the device and used. This consumable can be used for pet hair pickup, stain removal (use of a pad and chemistry to spot clean a stain), dislodging of pet hair or other methods of collecting particulate matter from a soft surface. This can be a dry cloth, a cloth impregnated with chemistry, a surface containing microencapsulated chemistry, or can be used as a semi permeable membrane to deliver chemistry to a surface (chemistry is in a liquid or gel form under the cloth).

In another embodiment, this fabric or cloth could be treated with chemistry that provides the user with a visual cue as to the state of the surface it passes over, similar to litmus paper. This consumable could do this in concert with another function, or simply as an indicator. Conditions it could be indicating are (but not limited to) the state of cleanliness of the surface, amount of allergens present, presence and degree of presence of specific contaminants or allergens, presence of biological entities, or odors.

FIG. 12A shows a consumable that can be (but not limited to) either just plain material with no support, or held within a ring or another form made of appropriate material so that the ring stretches the consumable "fabric" or mesh (could be non woven cloth, plastic, rubber composite or other combinations thereof) and presses to the surface of the motor housing base plate. The consumable is affixed to this surface by some means of adhesion or loop and hook method similar to that employed by the commercial product Velcro. The consumable is taken out of the package and then pressed onto the bottom of the device and used. This consumable can be used for pet hair pickup, stain removal (use of a pad and chemistry to spot clean a stain), dislodging of pet hair or other methods of collecting particulate matter from a soft surface. This can be a dry cloth, a cloth impregnated with chemistry, a surface containing microencapsulated chemistry, or can be used as a semi permeable membrane to deliver chemistry to a surface (chemistry is in a liquid or gel form under the cloth).

In another embodiment, this cloth could be treated with chemistry that provides the user with a visual cue as to the state of the surface it passes over, similar to litmus paper. This consumable could do this in concert with another function, or simply as an indicator. Conditions it could be indicating are (but not limited to) the state of cleanliness of the surface, amount of allergens present, presence and degree of presence of specific contaminants or allergens, presence of biological entities, or odors.

FIG. 13 shows a consumable that can be (but not limited to) made from either rubber, a rubber composite, bristles of various compositions (natural or man made, or a combination thereof), or various materials. This ring is pressed into a channel that is cut into the motor housing base plate. The consumable is taken out of the package and then pressed onto the bottom of the device and used. This consumable can be used for pet hair pickup, dislodging of pet hair for pickup by the device, or as a methods to dislodge or disturb matter (dust, dirt, bacteria, odors, etc) from a soft surface. This can also contain some chemistry which is wicked or drawn towards the surface being cleaned by chemical, physical or electrical means.

In another embodiment, this ring could be treated with chemistry that provides the user with a visual cue as to the state of the surface it passes over, similar to litmus paper. This consumable could do this in concert with another function, or simply as an indicator. Conditions it could be indicating are (but not limited to) the state of cleanliness of the surface, amount of allergens present, presence and degree of presence of specific contaminants or allergens, presence of biological entities, or odors.

Obviously, the above-mentioned "consumables" will need to also be replenished from time to time. Such consumable materials may be supplied to consumers in a kit wherein more than one composition is included in the kit, along with a set of instructions. The consumer will then select the appropriate consumable and cleaning composition depending on the different uses for the device, for example, according to the surface to be cleaned, the kind of cleaning desired, etc, in accordance with the instructions.

Figure 14:
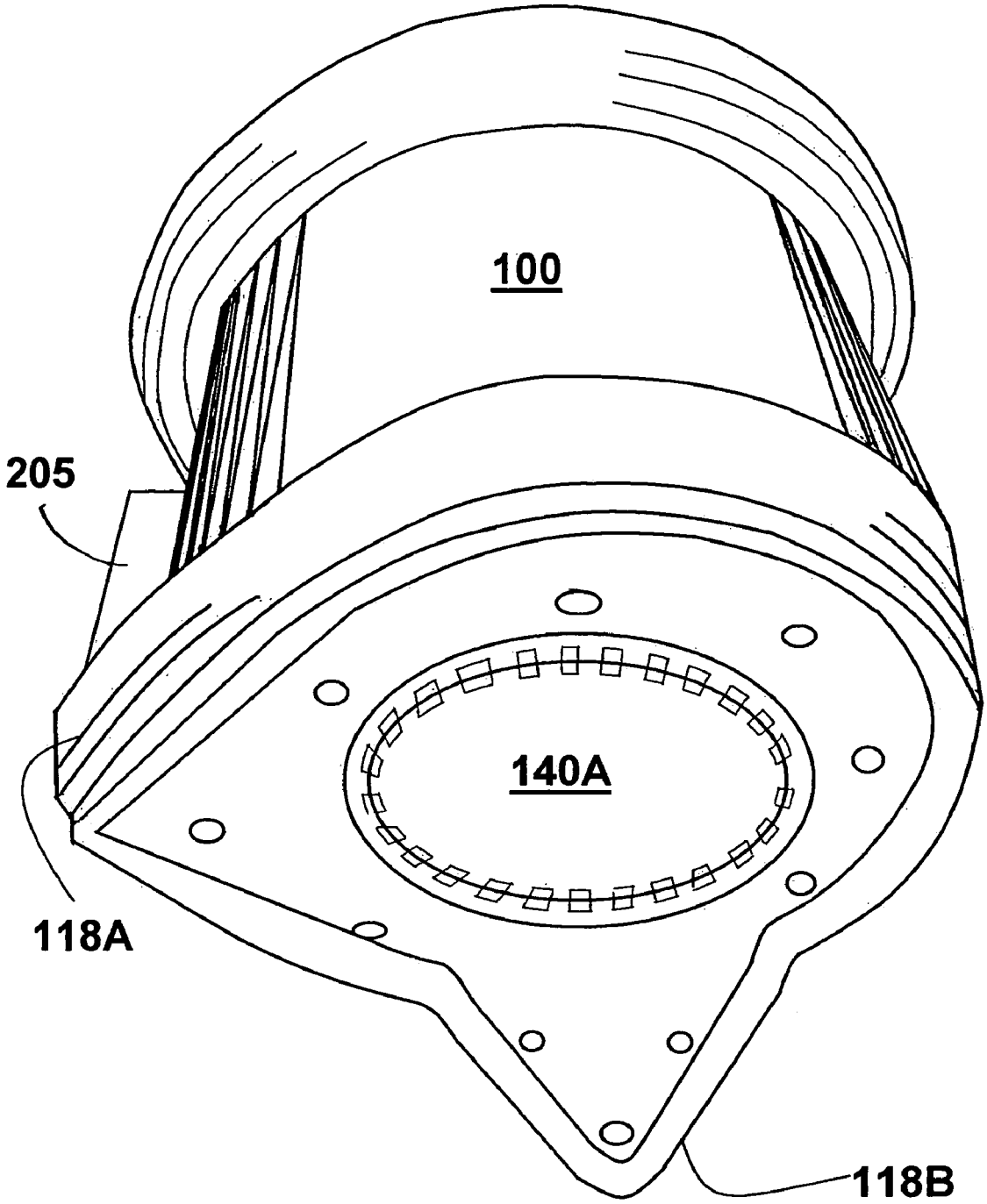
FIG. 14 illustrates a bottom up perspective view another possible embodiment.

FIG. 14 shows a unit 100 that has multiple corner pickup regions 118A, 118B to allow for greater flexibility of the unit 100, and better access to corners, between cushions, under cushions and thin areas where access to dust, dirt and debris is desired. This additional corner could be offset from the original corner pickup by 90 degrees, 180 degrees or 270 degrees.

Figure 15:
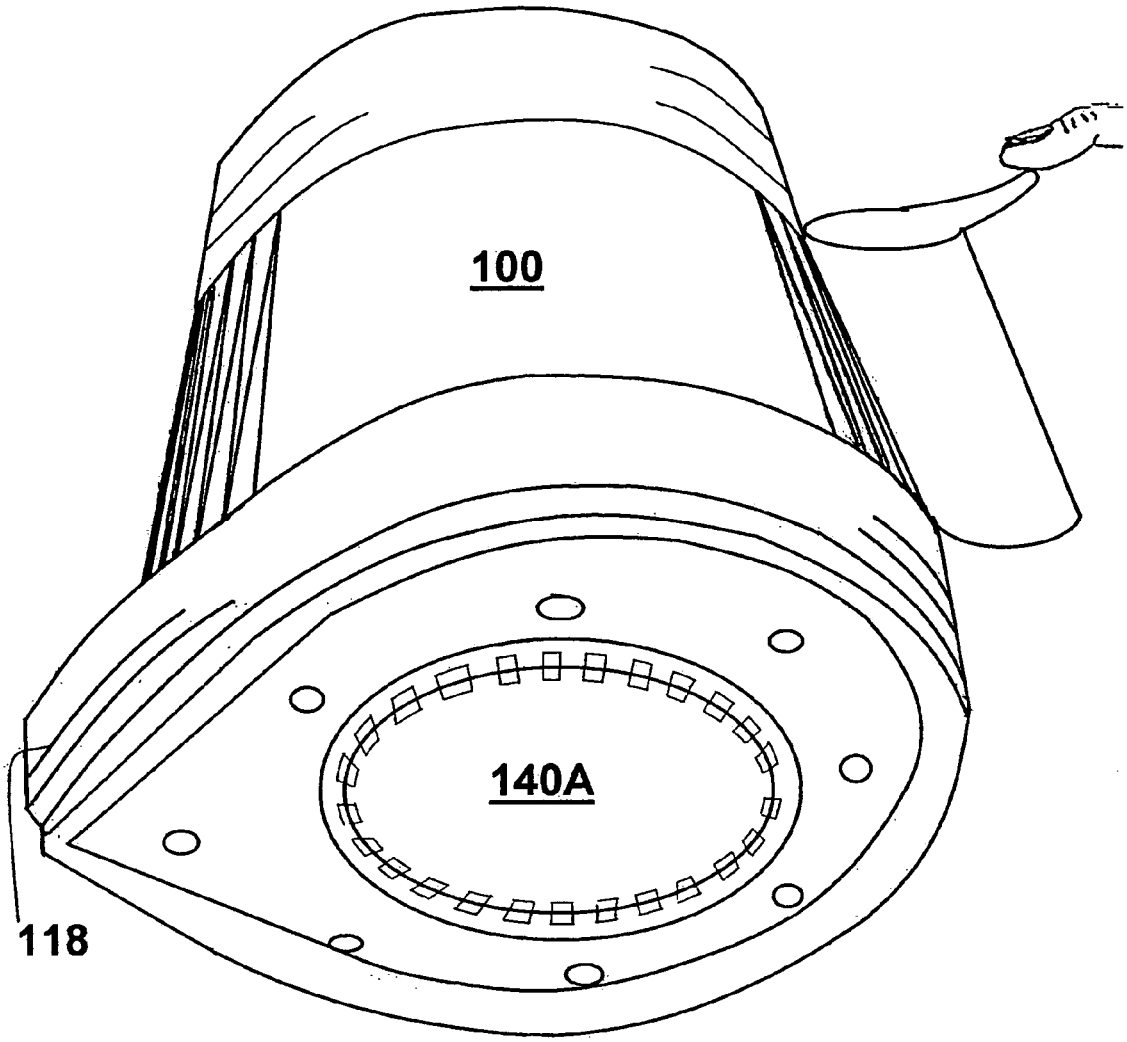
FIG. 15 illustrates a perspective view of yet another possible embodiment.
Figure 17A:
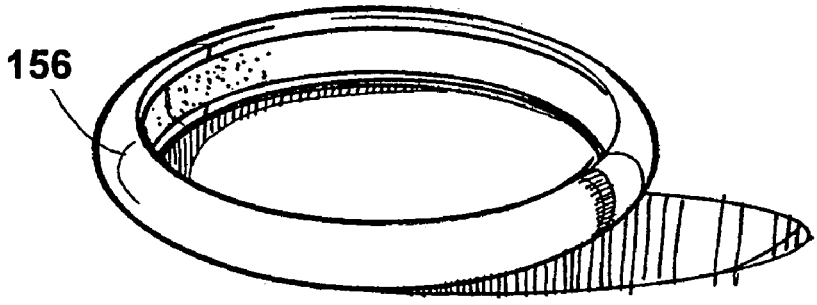
FIG. 17A illustrates another possible embodiment of a catch of the present invention.
Figure 17B:
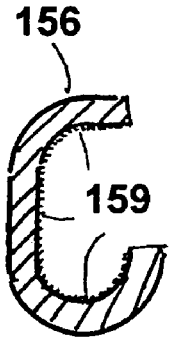
FIG. 17B illustrates a side view of the embodiment of FIG. 17A.
Figure 18A:
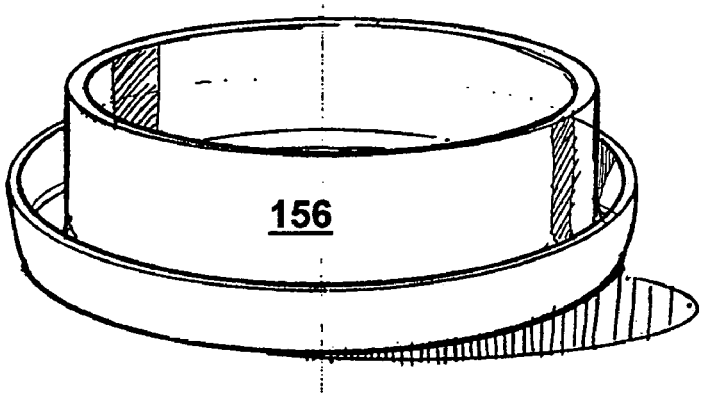
FIG. 18A illustrates another possible embodiment of a catch.
Figure 18B:
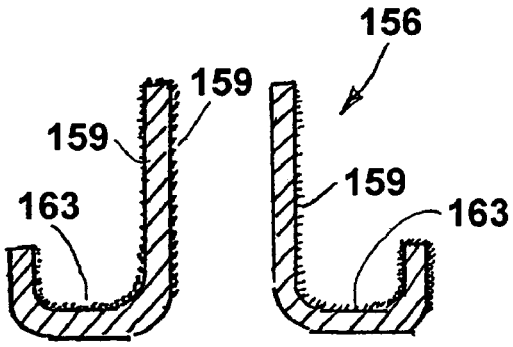
FIG. 18B illustrates a side view of the embodiment of FIG. 18A.
Figure 19A:
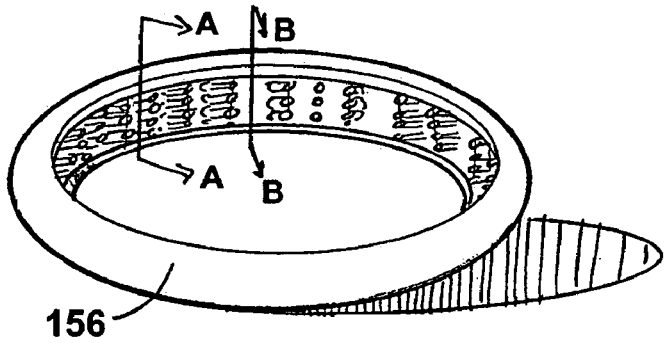
FIG. 19A illustrates yet another possible embodiment of a catch.
Figures 19B, 19C:
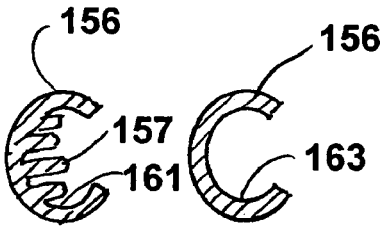
FIG. 19B illustrates a cutaway of the embodiment shown in 19A.
FIG. 19C illustrates a cutaway of another embodiment similar to that of FIG. 19A.
Figure 20B:
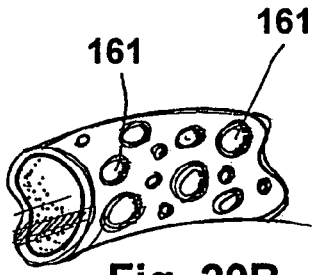
FIG. 20B illustrates a tear away of the embodiment shown in 20A.
Figure 20A:
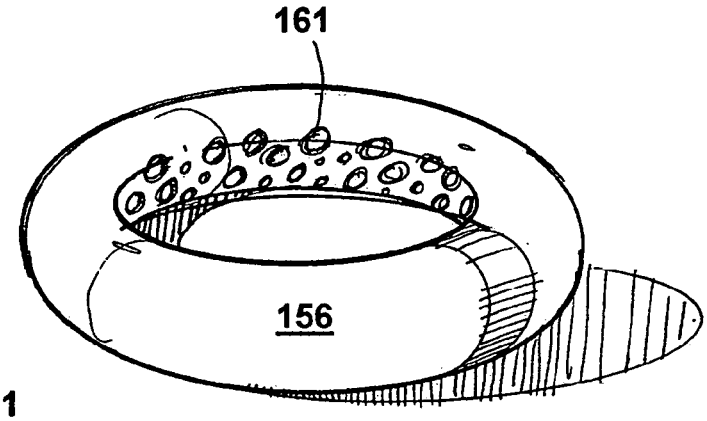
FIG. 20A illustrates still another possible embodiment of a catch.
Figure 20C:
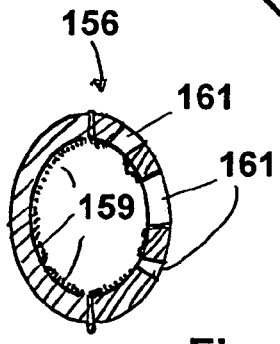
FIG. 20C illustrates a cutaway of the embodiment shown in 20A.
Figure 21A:
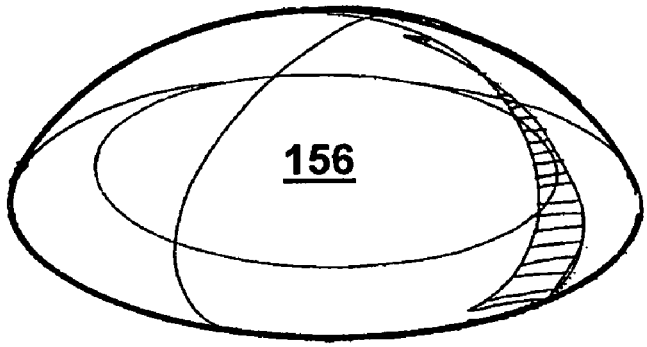
FIG. 21A illustrates a perspective view another possible embodiment of a filter of the present invention.
Figure 21B:
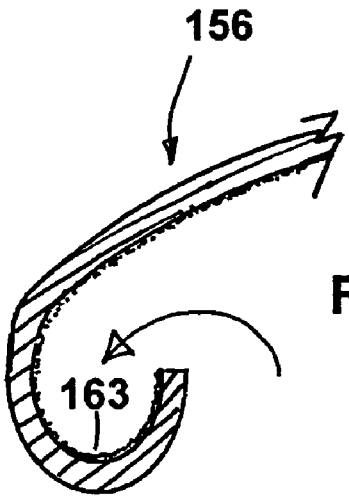
FIG. 21B illustrates a cutaway of the embodiment shown in 21A.

FIG. 15 shows an alternative method to deliver chemistry into the air stream or the device 100 using either an aerosol can 205. This aerosol can be inserted into a tube affixed to the unit 100, or molded onto the device and can be activated by a small button on top of the container. The consumer may be allowed determine the amount of chemistry used, or the use of a metered valve could be used to allow pre-determined doses of chemistry to flow. An alternate method would be to pour fluid into the container and allow it to venturi into the air stream. An alternate method would be to place a gel, solid or semi solid into the container and allow it to venturi into the air stream.

FIGS. 16A-C show a top schematic view for alternate shapes for the device 100. FIG. 16A shows an oval or egg shaped unit 100 with the corner pickup region 118 on the side. FIG. 16B shows an oval or egg shaped unit 100 with the corner pickup region 118 on the front or rear. FIG. 16C shows a triangle shaped unit, where the corners are all corner pickup regions 118A-C. In all cases, the second air channel is round or close to round to allow a vortex to form to aid in bringing dirty air into the consumable device.

FIGS. 17A-24C show many possible embodiments of a catch 156 of the present invention. In some embodiments, the catch 156 may have projections 157 or hair-like protrusions 159, pockets 161, or cavities 163 for better catching and holding dust and dirt which can be best seen in the cutaway views provided. Preferably, many of the embodiments are circular or donut-shaped and sit inside or adjacent to the return air channel as best shown in FIG. 8. Theses caches may be disposable filters made of non-wovens or may be able to be rinsed or cleaned and replaced. These catches may also be electrostatically charged or carbon-black filters.

Figure 22A:
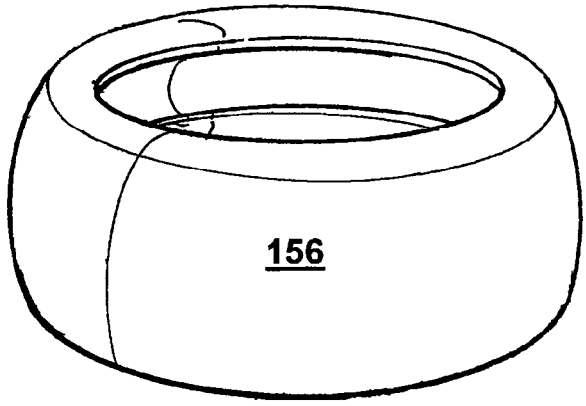
FIG. 22A illustrates a a perspective view another possible embodiment of a filter of the present invention.
Figure 22B:
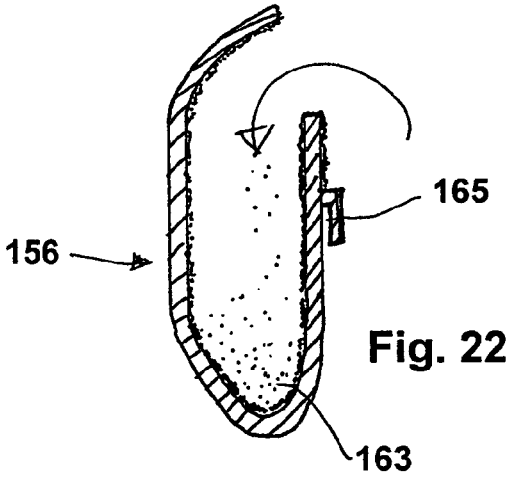
FIG. 22B illustrates a cutaway of 22A.

In the embodiment shown in FIGS. 22A and 22B, a clip 165 is provided for clipping the filter 156 in place within the unit.

Figure 23B:
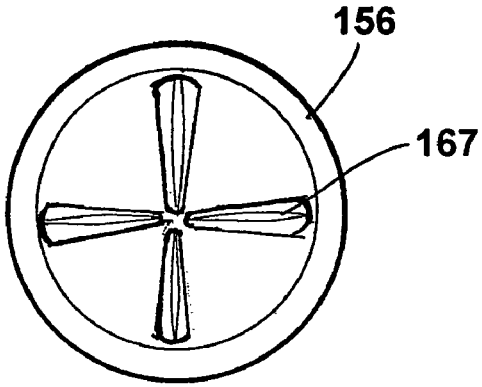
FIG. 23B illustrates a bottom view of 23A.
Figure 23A:
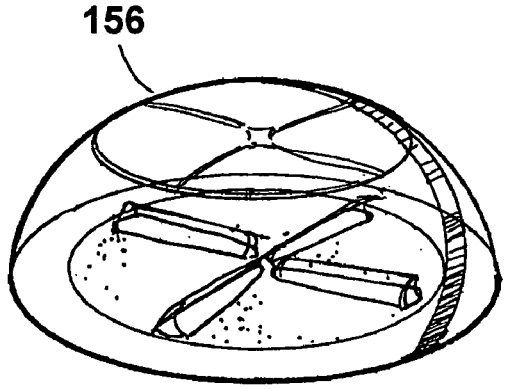
FIG. 23A illustrates a perspective view another possible embodiment of a filter.

In the embodiment shown in FIGS. 23A and 23B, slots 167 are provided for allowing fluids to easily travel in and out of hemispherical filter 156 while generally heavier dirt and dust is trapped.

Figure 24B:
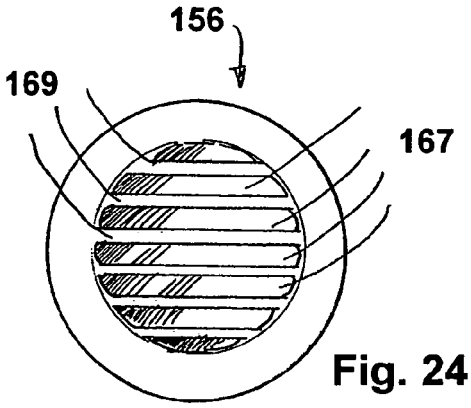
FIG. 24B illustrates a bottom view of 24A.
Figure 24A:
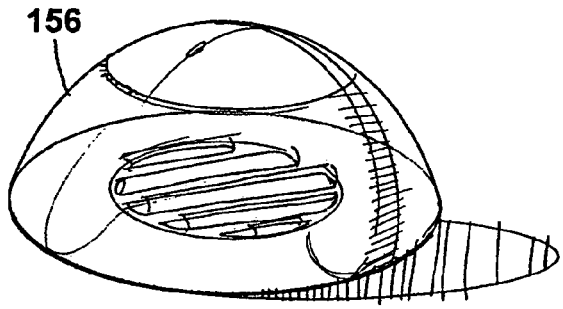
FIG. 24A illustrates yet another possible embodiment of a catch.
Figure 24C:
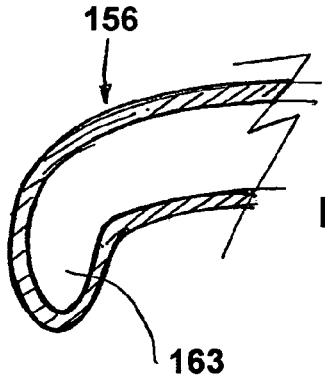
FIG. 24C illustrates a cutaway view of 24A.

In the embodiment shown in FIGS. 24A, 24B and 24C, slots 167 and vanes 169 are provided for allowing fluids to easily travel in and out of hemispherical filter 156 while generally heavier dirt and dust is trapped.

Figure 25:
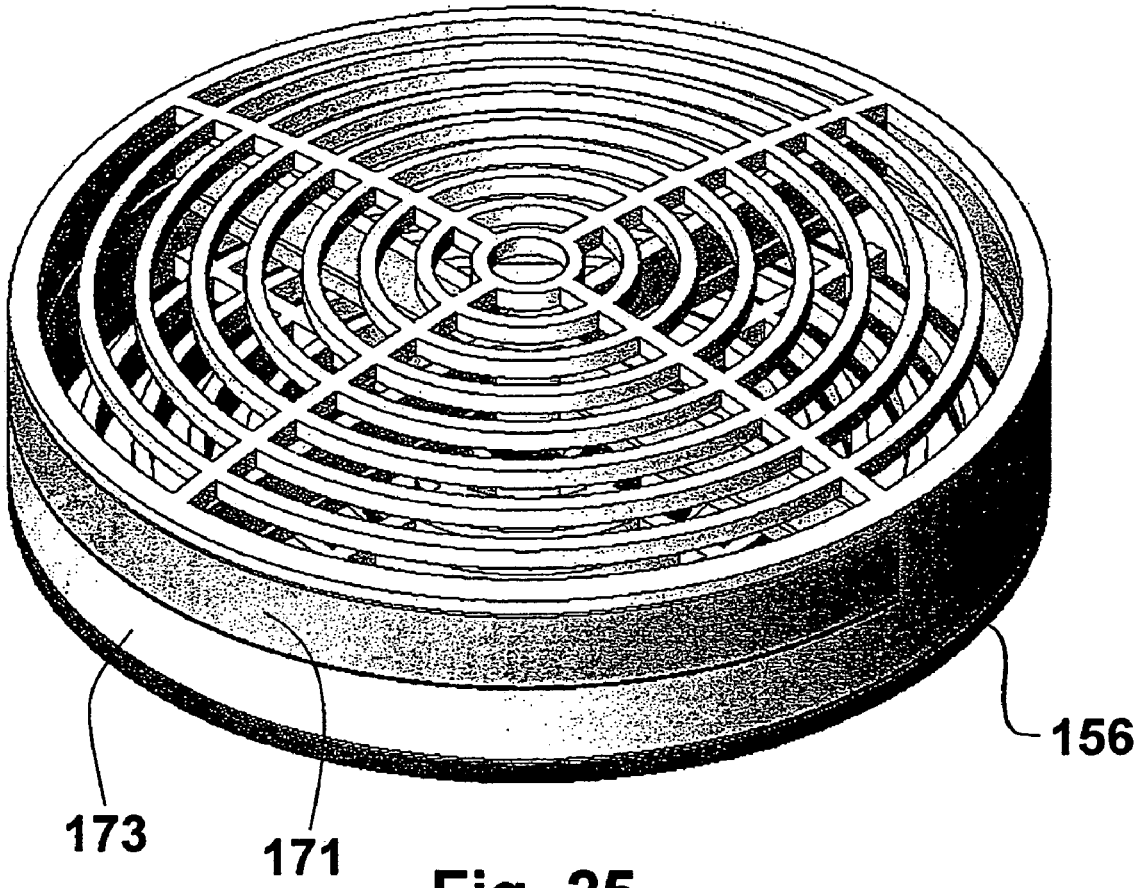
FIG. 25 illustrates a perspective view of yet another possible embodiment of a catch.
Figure 26:
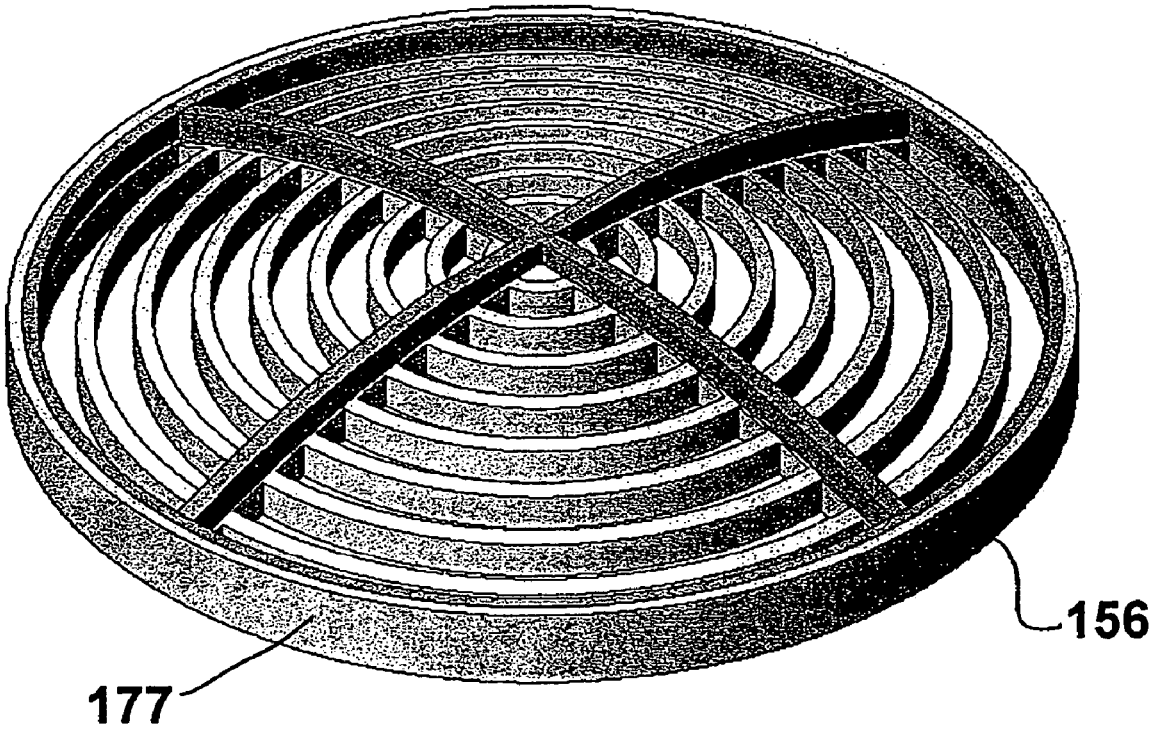
FIG. 26 illustrates a perspective view of yet another possible embodiment of a catch.

FIGS. 25 and 26 show a puck-like catch 156. In FIG. 25, the puck has a top section 171 and a bottom section 173. A cloth or pad may fit between the sections 171, 173 which may be press fit together.

FIG. 26 shows a catch having an outer ring 177 with vanes and slots arranged in circular configuration. This catch 156 may be made of a a plastic and reusable after cleaning. Alternatively, it may be made of paper or cardboard and disposable.

Figure 27:
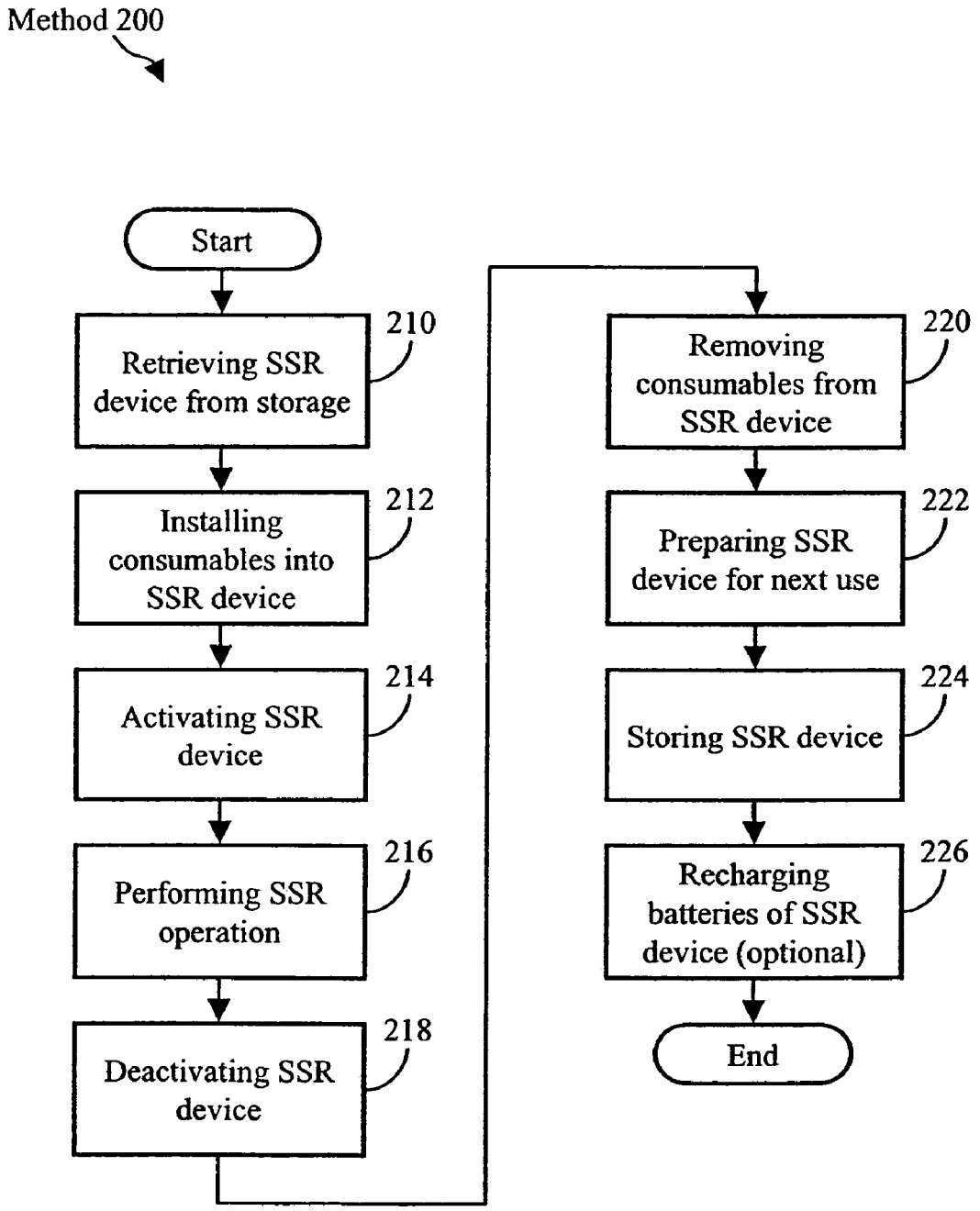
FIG. 27 illustrates a flow diagram of a method of performing soft-surface remediation by use of the SSR device of the present invention.

FIG. 27 illustrates a flow diagram of a preferred method 200 of performing soft-surface remediation by use of forced air SSR device 100 of the present invention. The inventive method 200 includes the following steps. As one of ordinary skill in the art will notice, the steps do not need to be necessarily practiced in the specific order set out below.

In step 210, a user retrieves forced air SSR device 100 from its storage location (which may be a battery recharging device).

In step 212, the user removes removable cover 120 atop outer housing 110 and installs a new or cleaned disposal catch mechanism 156, which may contain a chemical substance impregnated therein and/or installs the optional internally or externally mounted chemistry or active ingredient material delivery devices. The user then reinstalls removable cover 120 atop outer housing 110, optionally locking it into place. Method 200 proceeds to step 214.

During step 214, the user activates forced air SSR device 100 by a standard on/off switch and, thereby, activates AC or DC motor 154. As a result, fan impeller 150 rotates and creates a flow of air by drawing air into top air inlet 132 of inner housing 126, through first air chamber 162 and exiting bottom air outlet 164, passing around air restrictor 144, returning through bottom air inlet 168 and into second air channel 166, passing through disposal catch mechanism 156 and into return air channel 170, and returning back into top air inlet 132 to preferably form a closed loop system.

In step 216, the user preferably grasps handle 122 and brings brush 124, motor housing base plate 140, and standoffs 146 into contact with a surface to be cleaned, such as soft surface 180, as shown in FIG. 3, and moves forced air SSR device 100 over soft surface 180 by using any back-and-forth or side-to-side motion, until the entire surface has been cleaned. The combination of pressurized air exiting bottom air outlet 164 and the action of brush 124 and teeth 142 impinging upon soft surface 180 serves to dislodge contaminants, typically in the form of particulates and hair, from soft surface 180. These loose contaminants are caught in the airflow of forced air SSR device 100 and are, consequently, carried into bottom air inlet 168 for collection within forced air SSR device 100. More specifically, contaminants are drawn into second air channel 166, wherein any particles that are too heavy to flow the full distance of second air channel 166 to disposal catch mechanism 156 fall into second dust tray 134, because of gravity. The remaining contaminants are drawn the full distance of second air channel 166, wherein some portion of additional particles are captured within first dust tray 116 and any remaining and smallest contaminants are captured within disposal catch mechanism 156. Filtered air flows through return air channel 170 onto top air inlet 132 of inner housing 126 and returns to fan impeller 150. Additionally, any active ingredient that is impregnated within disposal catch mechanism 156 is delivered into the airflow of first air channel 162 by the action of fan impeller 150 and, subsequently, is driven into the fabric of soft surface 180 via bottom air outlet 164. As mentioned, the active ingredient may be delivered by the use of a device that is mounted internally in or externally to the unit, which may include a trigger spray, pump spray, aerosol, or similar means of delivering material, e.g., chemistry to the surface being treated. Furthermore, in order to perform the SSR operation in corners, the user may direct optional corner pickup region 118 into the corner to be cleaned.

In step 218, the user deactivates forced air SSR device 100 by a standard on/off switch, which deactivates DC motor 154.

In step 220, the user removes removable cover 120 atop outer housing 110. The disposal catch mechanism 156 and optional internally or externally mounted delivery device consumables are removed.

In step 222, the user empties first dust tray 116 and second dust tray 134, installs a cleaned or new disposal catch mechanism 156, replaces or refills optional internally or externally mounted delivery device and reinstalls removable cover 120 to prepare the device 100 for its next use.

In step 224, the user returns forced air SSR device 100 to its storage location.

Step 226 is optional for a DC powered device. If the batteries used in the device 100 are rechargeable batteries, the user plugs forced air SSR device 100 or the batteries into an associated battery-recharging device.

Figure 28:
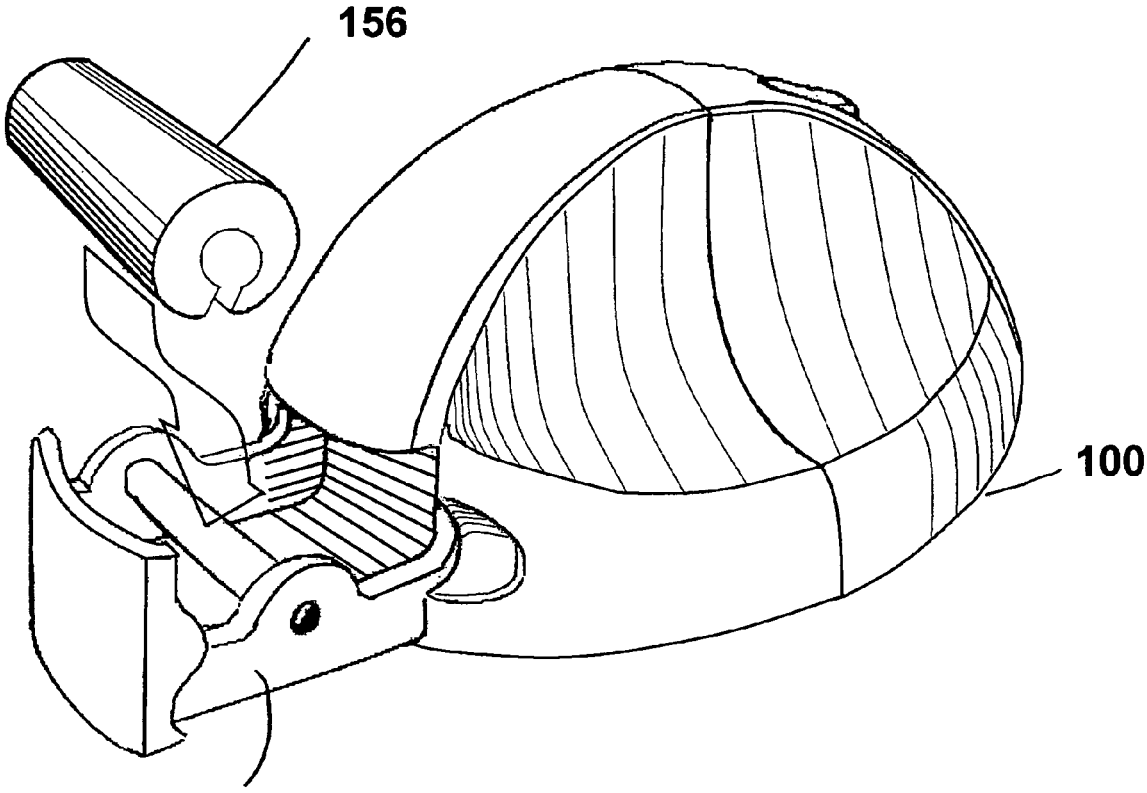
FIG. 28 illustrates a perspective view of yet another possible embodiment shown here used for cleaning a soft surface, for example, a couch.

FIG. 28 shows another embodiment of the device 100 of the present invention. In this embodiment, tray 183 slides out of the device body and cylindrical catch 156 is removed and replaced. The catch 156 has a cavity for fitting around a bar attached to the tray 183.

Figure 29:
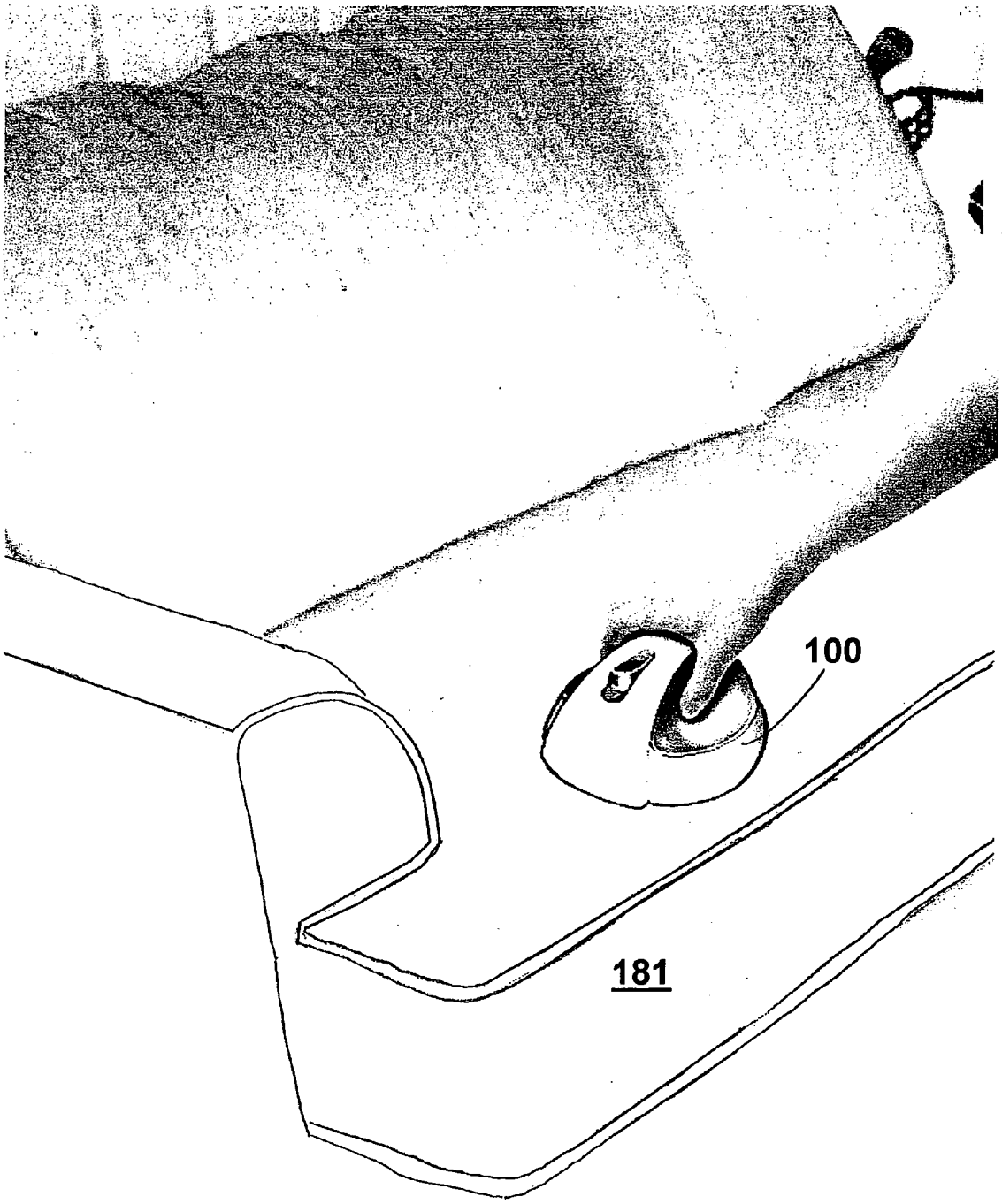
FIG. 29 illustrates yet another possible embodiment of a catch.

FIG. 29 shows the embodiment of FIG. 28 in use by a user on a article 181 having a soft surface, for example, a couch.

It will be apparent to one skilled in the art that the key features of the device discussed above improve upon the ability to quickly and easily displace, dislodge, and dispose of dirt and to disinfect and freshen by the removal of germs, mites, and odors. Further, while the device of the present invention is primarily used for touchup cleaning, it can have a variety of other uses. For example, the device of the current invention can be modified for enhanced microbial control, stain removal, and deep cleaning.

As will be further appreciated by one skilled in the art, other mechanisms may also be added to improve the cleaning mechanism of the above described device, such as the use of acoustic means, thermal means, steam means and/or electrostatic means to dislodge dirt, hair and other unwanted foreign matter. For example, microbial control may be better managed by addition of acoustic means. Moreover, using an electrostatic mechanism for touchup cleaning and freshening of fabric is also contemplated. In one embodiment, an ionizer may be added to freshen the air that travels through the cavity of the device.

The device may also be used as a special attachment for a vacuum specifically designed for cleaning upholstery or touch up cleaning. For example, key features from the device of the present invention may be incorporated into a handheld unit to form an extension to a common vacuum. Such vacuum extensions are easily detachable to the outermost end of the vacuum hose and are well known the art.

The device of the present invention is both economical and effective. The effectiveness of such a device may be calculated by special measurement diagnostics and metrics that measure the device's ability to displace, dislodge, and dispose of dirt and to disinfect and freshen by the removal of germs, mites, and odors. These include a variety of measurements.

As consumers are generally not familiar with such a device, objection to the present invention may be overcome by educating consumers in the use of such a device for soft surface remediation, particularly for touchup cleaning. The present invention encompasses a method of promoting the sale of such a device. The present invention further encompasses a method of promoting the sale of such a device by associating the device with the terms selected from the group consisting of remediator, soft surface remediator, Glade-ator, Zephyr, HoverBee, GlideAir, Oust and the like and combinations thereof.

The device may also include a mechanism that allows the user to see that the disposal catch mechanism is dirty and needs to be replaced or to hear that the disposal catch mechanism is full and needs to be changed. This may include a pressure alarm, a light sensor, a power sensor, a tri-color LED device or some other such device.

In another embodiment, the device may have attachable legs so that the device may be stationary for use also as an air filter, air purifier, fragrancer, a deodorizer, and/or remediator.

In yet another embodiment, the device has robotic systems to move the device along a surface without direct user interface.

Although the best mode contemplated by the inventor of carrying out the present invention is disclosed above, practice of the present invention is not limited thereto. It will be manifest that various additions, modifications and rearrangements of the features of the present invention may be made without deviating from the spirit and scope of the underlying inventive concept. For example, it should be noted that although the device of the present invention is preferably for use in the home, it also may be used during the furniture assembly process to clean the fabric and protect it before the furniture is assembled and the fabric is secured at the place thereon. Further, such a device can be used in furniture warehouse in showrooms to spruce up the furniture before it is put on display or before it is shipped to the purchaser. The device may also be used after the furniture has been used and is about to be discarded. For example, in some instances the fabrics, batting, foams, and other soft surfaces may be reused and recycled for other applications if they can properly be cleaned, disinfected, and renewed. The Applicant is unaware that any such device exists currently. Therefore, adapting the disclosed inventive device to this purpose could greatly aid in the recycling process.

In addition, the individual components disclosed herein need not be fabricated from the disclosed materials, but may be fabricated from virtually any suitable materials. Moreover, the individual components need not be formed in the disclosed shapes, or assembled in the disclosed configuration, but may be provided in virtually any shape, and assembled in virtually any configuration. Further, although several components are described herein as physically separate modules, it will be manifest that many components may be integrated into the apparatus with which it is associated. Furthermore, all the disclosed features of each disclosed embodiment may be combined with, or substituted for, the disclosed features of every other disclosed embodiment except where such features are mutually exclusive.

What is claimed is:

1. A hand held, forced air soft surface remediation device having a housing defining at least a first and a second air channel, the air channels in fluid communication at both ends of the channels;

a cover removably attached to the housing;

a removable filter in fluid communication with at least one of the air channels;

a fan within the housing;

a motor attached to and configured to rotate the fan;

a means for assessing if the filter needs to be changed;

a pickup orifice in communication with the housing;

at least one dust tray in communication with one of the air channels;

at least one dislodging member mounted to a bottom surface of the housing;

at least one standoff mounted to the bottom surface of the housing and positioned between the first and second air channels;

a mechanism to introduce chemistry onto the surface in fluid communication with the fan.

2. The device of claim 1, further comprising a handle configured to allow the user to move the housing from horizontal to vertical position.

3. An apparatus for cleaning a surface comprising an outer shell defining at least a portion of a closed loop air flow system;

a reservoir for holding a chemistry that moves within the shell;

an impeller for creating within the shell a higher pressure air flow in a first direction and lower pressure in a second direction;

a motor for spinning the impeller; and a retaining means for securing removable attachments to a bottom surface of the housing.

4. The device of claim 3, further comprising a system for atomizing and delivering the chemistry to the surface and for then removing it from the surface.

5. The device of claim 4, wherein the device creates at least one internal vortex for moving the chemistry within the housing.

6. The device of claim 4 wherein the chemistry remediates at least one of a: pillow, mattress, carpet, car interior, drape, window, floor, plumbing drain, insect habitat, and couch.

7. The device of claim 3, further comprising a material delivery means in fluid communication with at least one air channel, and wherein the motor is driven by rechargeable battery power.

8. The device of claim 3, wherein the device is configured to fit into the hand of a user; and at least one integral corner pickup region adjacent the housing.

9. The device of claim 3, further comprising a removable cover attached to the outer shell at a top, wherein the cover is at least one of: a screwed on cover, clip-on cover, and a transparent cover.

10. The device of claim 3, further comprising a disposable filter.

11. The device of claim 10, further comprising a mechanism that allows the user to see that the disposable filter is dirty and needs to be replaced.

12. The device of claim 10, further comprising a mechanism to allow the user to hear that the disposable filter is full and needs to be changed.

13. The device of claim 10, wherein the disposable filter is an easily removable and recyclable filter.

14. The device of claim 10, wherein the disposable filter is a HEPA filter.

15. The device of claim 3, wherein the chemistry includes at least one of the following: cleaners, odor eliminators, fresheners, protectants, herbicides, repellants, insecticides, antimicrobials, fragrances and disinfectants all of which may be in the form of liquids, gases, solids, gels and/or powders or combinations thereof.

16. The device of claim 3, wherein the chemistry includes at least one of: insecticide, herbicide, a fungicide, antimicrobial, drain cleaner, repellant, refresher, fragrance, and odor neutralizer.

17. The device of claim 3, wherein the motor is impervious to water so that the device can be used in areas containing liquids.

18. A cleaning device comprising an outer housing, an inner housing in communication with the outer housing, a motor housing adjacent to the inner housing for housing a motor and fan assembly, a first air channel with a first air outlet and a second air channel with a second air inlet in fluid communication with the inner housing and fan, a return air channel in communication with at least one air channel, at least one dust tray in communication with one of the air channels, a replaceable catch mechanism in fluid communication with at least one air channel, and a foam cleaner which after being first set down by an outward flow is then picked up by the device.

19. A cleaning device comprising an outer housing, an inner housing in communication with the outer housing, a motor housing adjacent to the inner housing for housing a motor and fan assembly, a first air channel with a first air outlet and a second air channel with a second air inlet in fluid communication with the inner housing and fan, a return air channel in communication with at least one air channel, at least one dust tray in communication with one of the air channels, and a replaceable catch mechanism in fluid communication with at least one air channel, wherein:

a first dust tray is positioned substantially along a lower end of the second air channel and is connected to one of the outer, inner, or motor housings, and a second dust tray is positioned substantially along an upper end of the second air channel and is connected to one of the outer, inner, or motor housings.

20. The device of claim 19 further comprising a removable catch mechanism disposed in at least one of the dust trays.

* * * * *